US006082852A

United States Patent [19]

Soga et al.

[11] Patent Number: 6,082,852

[45] **Date of Patent: *Jul. 4, 2000**

[54] RECORDING APPARATUS, PRINTER, AND AN INK TANK THEREIN

[75] Inventors: Mitsuhide Soga; Jun Takagi; Katsuyuki Fujii; Ichiro Tomikawa; Kazuyuki Oda; Fumihiko Ogasawara; Junichi Yoshida, all of Ebina, Japan

[73] Assignee: Fuji Xerox Co., Ltd, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,796

[22] Filed: Apr. 22, 1997

[30] Foreign Application Priority Data

Apr. 23, 1996 [JP] Japan ..... 8-101517
May 15, 1996 [JP] Japan ..... 8-120075

[51] Int. Cl.[7] ..... B41J 2/175
[52] U.S. Cl. ..... 347/86
[58] Field of Search ..... 347/85, 86, 87

[56] References Cited

U.S. PATENT DOCUMENTS 4,771,295 9/1988 Baker et al. .
5,886,721 3/1999 Fujii et al. ..... 347/87

FOREIGN PATENT DOCUMENTS 50-74341 6/1975 Japan .
2-214665 8/1990 Japan .
3-92356 4/1991 Japan .
6-966 1/1994 Japan .
6-255121 9/1994 Japan .
6-272745 9/1994 Japan .
6-272747 9/1994 Japan .
7-148938 6/1995 Japan .
7-268752 10/1995 Japan .
8-132633 5/1996 Japan .

*Primary Examiner*—N. Le
*Assistant Examiner*—Michael Nghiem
*Attorney, Agent, or Firm*—Oliff & Berridge, PLC

[57] ABSTRACT

A recording apparatus having a print head for printing characters on a medium and an ink tank for holding ink to be supplied to the print head. The ink tank includes an ink chamber having an ink holding member and an ink supplying port. A first meniscus forming member is located in the ink supplying port so as to be in communication with the ink holding member. The print head includes an ink introducing port for receiving ink from the ink tank and a second meniscus forming member located in the ink introducing port. When the ink tank is attached to the print head, the ink introducing port is coupled with the ink supplying port. An ink passing member is located in the portion where the ink introducing port is coupled with the ink supplying port. The ends of the ink passing member are in contact with the first meniscus forming member and the second meniscus forming member. The ink passing member is subject to only minor changes in volume upon contact with ink.

24 Claims, 13 Drawing Sheets

RECORDING APPARATUS, PRINTER, AND AN INK TANK THEREIN

BACKGROUND OF THE INVENTION

The present invention relates to a recording apparatus for recording characters, for example, on a recording medium by utilizing liquid ink. More particularly, the invention relates to a recording apparatus of which an ink tank alone can be replaced with another, and an ink tank used for the recording apparatus.

A recording apparatus (referred to simply as a printer) with an ink tank detachably attached thereto, and an ink tank are disclosed in the Unexamined Japanese Patent Application Publication No. Hei. 6-255121. In the publication, an ink holding member, which is disposed in an ink tank, holds ink therein. When the ink tank is attached to the printer, an ink introducing port of a recording head (referred to as a print head) is brought into contact with the ink holding member.

Usually, an urethanes material is used for making the ink holding member 3*a*. A recent market demands the improvement of a print quality (waterproofness of print). With the demand, ink tends to take an increase of its pH value. A demand for the development of the ink holding member formed of felt as a material resistive to a high pH ink is also increasing. Also in the publication, the felt is used for making the ink holding member in order to increase its capabilities of ink holding and ink supplying.

In the construction of the publication, the ink introducing port of the print head directly pushes the ink holding member. Therefore, if the attaching and detaching of the ink tank to and from the print head are repeated, the ink holding member will be deformed, and a rate of used ink to ink contained in the ink tank (referred to as an ink use rate) will be decreased. Particularly when the felt is used for the ink holding member, the decrease of the ink use rate is remarkable. The reason for this follows. To manufacture ink tanks of the same size, the ink holding member, when felt is used, must be formed at a lower pressure than when urethanes is used. Therefore, a reaction force of the ink holding member formed of felt is weak, a posture variation of the ink holding member is great, and the ink holding member is hart to resume its original posture.

A solution to the problem is proposed in the Unexamined Japanese Patent Application Publication No. Hei. 7-148938. In the publication, the ink passing member is directly jointed to the ink holding member within the ink tank. When the ink tank is attached to the print head or the printer, the ink introducing port of the print head is pressed against the ink passing member, to thereby form a passage of ink. With the structure, the ink holding member is not deformed by the attaching and detaching of the ink tank. Therefore, the problem as mentioned above does not arise.

In the structure where the ink passing member is press fit to the ink holding member, the ink holding member is deformed in the jointing portion where the ink holding member is coupled with the ink passing member. Because of this, a gap is formed between the ink holding member and the wall surface of the ink tank. Air staying there enters the jointing portion to possibly close the ink passage. The ink held by the ink holding member is not fully used.

As shown in FIG. 1C in the Japanese Patent Application No. Hei. 7-268752, a unique ink tank is constructed such that the meniscus forming member having a plural number of minute perforations is brought into contact or press contact with the ink holding member. In the ink tank thus constructed, it is possible to improve a degree of the contact of the inner wall of the ink tank with the ink holding member. Therefore, the entering of air bubbles into the ink tank can be reduced to an extreme. If air enters the ink tank, it is trapped with the surface of the meniscus forming member to allow little air to enter the inside of the print head. In the ink tank of the publication, material of felt may be used for making the ink holding member, in addition to the materials of urethanes.

The ink tank under discussion suffers from the following problem, however. When the ink tank is attached to the printer, air stays in a space between the meniscus forming member and the ink introducing port of the print head. Such air can insufficiently be removed if it is sucked from the nozzle side in its maintenance. This causes a printing problem.

Another jointing structure is disclosed in the Unexamined Japanese Patent Application Publication No. Hei. 6-272745. In the structure, a porous member of which the volume is variable is provided at the jointing portion between the ink tank and the print head. When the ink tank is detached, and the porous member expands in its volume, the porous member absorbs an amount of air corresponding to the expanded volume of the porous member. This leads to the printing problem.

Further, the present invention relates to a printer having a print head for printing characters, for example, on a printing medium by ejecting ink droplets to the printing medium, and an ink tank which holds ink therein to be supplied to the print head and is detachably connectable with the print head, and an ink tank used for the printer. More particularly, the invention relates to a jointing structure for jointing the ink tank to tho print head when the ink tank is attached to the print head.

The ink jet printer is widely used because of its many advantageous features, for example, high quality print picture, low noise generation, and the like. Particularly, its size may be reduced in design. Because of this feature, most of the ink jet printers currently marketed are provided for personal use. In handling small printers for personal use, when ink is used up, the user replaces an old ink jet cartridge with a new one. The cartridge is formed integral with an ink tank or a print head. Particularly where only the ink tank is replaced, the replacement entails no increase of cost since the ink tank is relatively inexpensive, and hence the reduction of running cost of the printer.

The printer of this type in which the ink tank is replaced for supplying ink to the printer suffers from the following problem. When the ink tank is replaced with a new one, ink oozes out in the jointing portion of the ink tank, and sometimes the oozed ink soils the hand of a user or drips onto the printer body.

A technique to solve this problem is disclosed in the Unexamined Japanese Patent Application Publication No. Hei. 3-92356. In the technique, an ink supplying port located at the lower side of the ink tank is constructed with a rubber plug. The rubber plug is pierced with an ink supplying needle made of metal, so that the ink tank is communicatively connected to an ink passage destined to the print head. The ink supplying needle used is resistive to corrosion by ink, and its tip is extremely sharp so that it can easily pierce the rubber plug. When the ink tank is detached from the print head, the ink supplying port of the ink tank closes by an elasticity of the rubber plug. Therefore, no ink leaks from the ink tank. When the ink tank is detached from the printer, the user mistakenly touches the sharp tip of the ink supplying needle and is injured by the sharpened tip. The inside diameter of the ink supplying needle is small. Therefore, when the rubber plug is broken with the needle and broken pieces of the rubber plug produced enters the through hole of the needle, the needle will be clogged with the broken piece.

Another technique to solve the problem is disclosed in the Unexamined Japanese Patent Application Publication No. Sho. 50-74341. The technique is based on such a jointing structure as to allow a liquid introducing pipe whose tip is not so sharp to pass therethrough. In the jointing structure, a cover plate with perforations, made of rubber, for example, is placed at the end of the ink supplying port. The perforations of the cover plate are sealed with a thin film with slits, made of rubber, for example. Also in the jointing structure, a slight amount of ink leaks through the perforations and the slits.

A further technique is disclosed in the Unexamined Japanese Patent Application Publications Nos. Hei. 2-214665 or Hei 6-966. The following jointing structure is employed in the solution. In the means, a jointing portion of the ink tank is sealed with a sealing member. A jointing portion of the printer is constructed with a porous rigid member having boring protrusions formed on the periphery thereof. To attach the ink tank to the printer, the sealing member of the ink tank is bored with the boring protrusions of the porous rigid member, and the porous rigid member of the ink tank is pressed against the porous member in the ink tank. The tip of the ink supplying pipe with the porous rigid member is wide enough to prevent the pipe from being clogged with a broken piece of the sealing member. The boring protrusions of the porous rigid member may be not so sharp. Therefore, there is less chance that an operator is injured by the protrusions. In an initial state, the jointing portion is sealed with the sealing member, so that no ink leaks from the ink tank. In the jointing structure, the porous rigid member is always impregnated with ink. Therefore, when the ink tank is attached to and detached from the printer, supplied ink drips.

Various color printers have been developed and marketed. In the color printer, a unit type print head capable of printing, for example, characters of a plural number of colors comes into use. In the unit type print head, leaked or dripping ink leads to a mixture of different colors of inks.

A jointing structure to eliminate the leakage or dripping of ink is proposed in tho Unexamined Japanese Patent Application Publication No. Hei. 6-272747. In the structure, a porous member is provided at the jointing portion of the ink tank. The volume of the porous member when the ink tank is attached is different from that when the ink tank is detached. When the ink tank is detached from the printer, the porous member expands to absorb ink. Then, there is less chance of dripping ink. When the porous member expands, it absorbs air, together with ink. When the ink tank is attached to the printer, air absorbed by the porous member is left in the ink passage. The left air possibly leads to print defects.

A pressure contact sometimes ensues an instable ink supply. A technique is known in which the extended pipe is pressed against the capillary member to increase a density of the capillary pipe to thereby supply ink, as described in (d) in claim 11 of U.S. Pat. No. 4,771,295, for example. In the technique, when the pressing force is small, the density of the capillary member is small. In this state, in supplying ink, air is sucked together with ink. Conversely, when the pressing force is large, the density of the capillary member is too large, to adversely affect the ink supply. The jointing structure in which the expanded pipe is pressed against the capillary member, the characteristic of the printer depends easily on a quantity of press contact. The manufactured products are not uniform in characteristics. Therefore, the printer based on this jointing structure frequently suffers from print defects.

SUMMARY OF THE INVENTION

With the view of solving the above problems, the present invention has an object to provide a printer which keeps a good ink use rate even when the ink tank is attached and detached to and from the printer, reduces the number of print defects, and provides a good print picture, and an ink tank in use with the printer.

To achieve the above object, the invention defined by aspect 1*a* provides a printer having a print head for printing characters, for example, on a printing medium by ejecting ink droplets to the printing medium, and an ink tank for holding ink therein to be supplied to the print head, the improvement characterized in that 1) the ink tank includes:

an ink chamber having an air through-hole and an ink supplying port, the ink chamber being communicatively connected to the outside air through the air through-hole and supplying ink to the print head through the ink supplying port; an ink holding member contained in the ink chamber; and a first meniscus forming member with minute perforations formed therein, located within the ink supplying port so as to communicate with the ink holding member;

2) the print head includes:

an ink introducing port for introducing ink from the ink tank into the print head; and a second meniscus forming member located in the ink introducing port;

wherein when the ink tank is attached to the print head, the ink introducing port is coupled with the ink supplying port, and an ink passing member in contact with the ink introducing member or the second meniscus forming member is provided in a portion where the ink introducing port is coupled with the ink supplying port.

Preferably an ink holding force of the ink passing member is equal to or larger than an ink holding force of the ink holding member.

Preferably the ink passing member is located in the ink supplying port, and when the ink tank is attached to the print head, the ink passing member is brought into contact with the second meniscus forming member.

Preferably the ink passing member is in contact with the first meniscus forming member.

Preferably the minute perforations of the second meniscus forming member are comparable with or more minute than the minute perforations of the first meniscus forming member.

Preferably the second meniscus forming member is placed on the upper surface of the ink introducing port and sealed with an elastic member.

Preferably print head for printing characters, for example, on a printing medium by electing ink to the printing medium, the ink tank comprising:

an ink chamber having an air through-hole and an ink supplying port, the ink chamber being communicatively connected to the outside air through the air through-hole and supplying ink to the print head through the ink supplying port;

an ink holding member contained in the ink chamber; and a meniscus forming member with minute perforations formed therein, located within the ink supplying port in contact with the ink holding member; and an ink passing member located in the ink supplying port, when the ink tank is attached to the print head, the ink passing member being brought into contact with an ink introducing port of the printer.

Preferably an ink holding force of the ink passing member is equal to or larger than an ink holding force of the ink holding member.

Preferably the ink passing member is in contact with the meniscus forming member.

Accordingly, an object of the present invention is to provide a printer and an ink tank which eliminate the ink leakage caused by attaching and detaching the ink tank, and prevent the entering of air into the ink passage when the ink tank is attached, whereby there is a less chance of forming print defects.

Preferably there is provided a printer having a print head for printing characters, for example, on a printing medium by ejecting ink droplets to the printing medium, and an ink tank for holding ink therein to be supplied to the print head, the improvement characterized in that the ink tank comprises:

a main ink chamber having an air through-hole and an ink through-hole, the main ink chamber being communicatively connected to the outside air through the air through-hole and supplying ink to the print head through the ink through-hole;

an ink-chamber capillary member contained in the main ink chamber;

a first meniscus forming member with minute perforations formed therein, located within the ink through-hole while being in contact with the ink-chamber capillary member;

an intermediate chamber having a jointing means provided in the bottom portion thereof, and communicating with the main ink chamber through the ink through-hole and the first meniscus forming member, tho intermediate chamber being jointed to the print head by the jointing-means; and a jointing-portion capillary means being placed in the jointing means.

Preferably print head includes an ink introducing means to be coupled with the jointing means of the ink tank, a filter is formed on the face of the ink introducing means which is confronted with the jointing means of the ink tank, and when the ink tank is attached to the print head, the filter of the ink introducing means is brought into contact with the jointing-portion capillary means of the jointing means.

Preferably the printer set forth in aspect 11 such that the filter is formed with a metal mesh.

Preferably a capillary force of the jointing-portion capillary means is weaker than that of the ink-chamber capillary member.

Preferably the printer set forth in aspect 10 such that the jointing-portion capillary means located in the jointing means includes a second meniscus forming member with perforations formed therein, and a jointing-portion capillary member.

Preferably there is provided an ink tank detachably connectable to a print head of a printer for printing characters, for example, on a printing medium by ejecting ink to the printing medium, the ink tank comprising:

a main ink chamber having an air through-hole and an ink through-hole, the main ink chamber being communicatively connected to the outside air through the air through-hole and supplying ink to the print head through the ink through-hole;

an ink-chamber capillary member contained in the main ink chamber;

a first meniscus forming member with minute perforations formed therein, located within the ink through-hole while being in contact with the ink-chamber capillary member;

an intermediate chamber having a jointing means provided in the bottom portion thereof, and communicating with the main ink chamber through the ink through-hole and the first meniscus forming member, the intermediate chamber being jointed to the print head by the jointing means; and a jointing-portion capillary means being placed in the jointing means.

Preferably a second meniscus forming member is further located in the jointing means.

DETAILED DESCRIPTION OF THE PREFERRED EMBODIMENTS

Figure 1A:
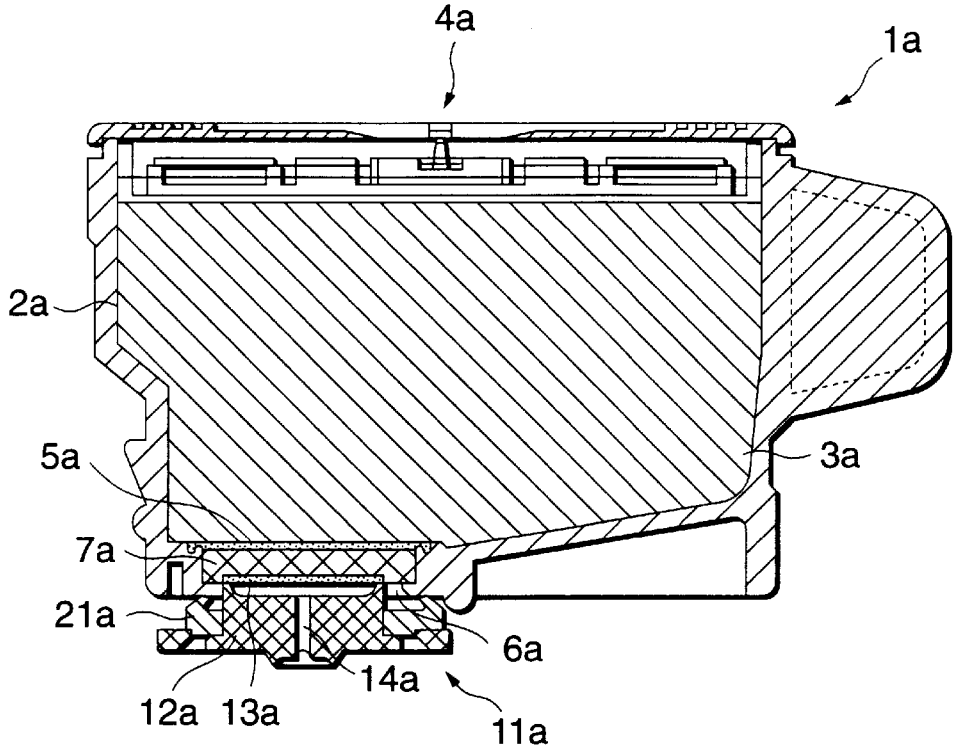
FIGS. 1A and 1B are cross sectional views showing embodiments of an ink tank and a point head according to the present invention.
Figure 1B:
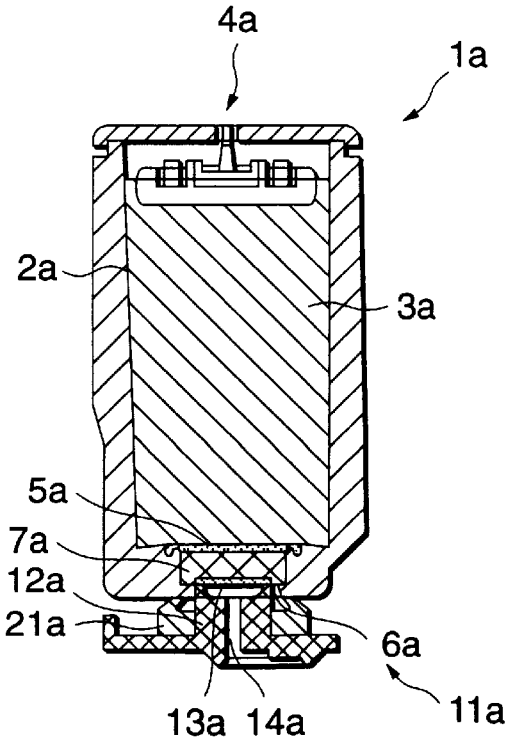
Figures 2A, 2B, 2C:
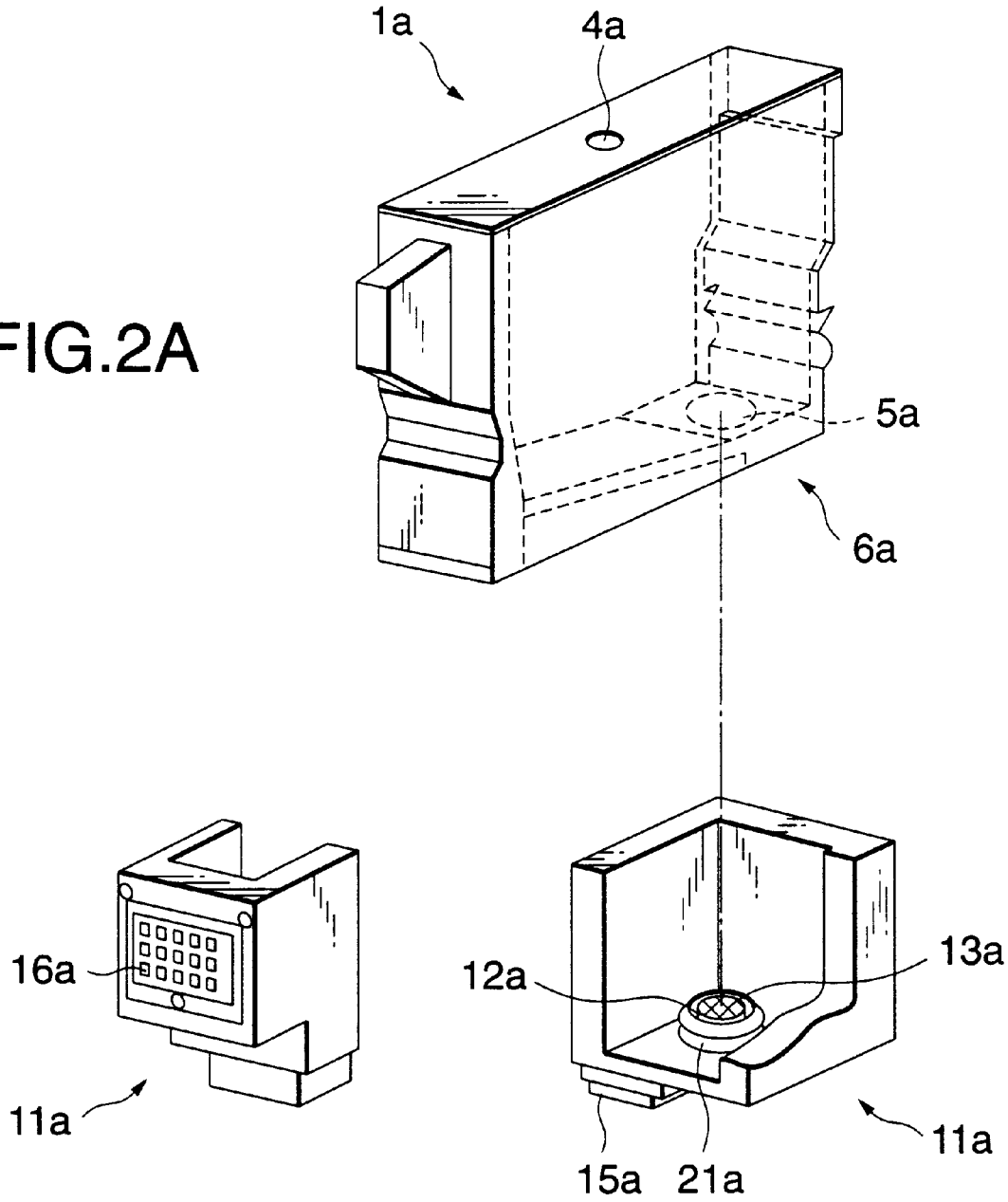
FIGS. 2A to 2C are perspective views showing the ink tank and the print head when the ink tank is detached from the print head.

FIGS. 1A and 1B are cross sectional view showing embodiments of an ink tank and a print head according to the present invention. FIGS. 2A, 2B and 2C are perspective views showing the ink tank and the print head when the ink tank is detached from the print head. In the figures, reference numeral 1*a* designates an ink tank; 2*a,* an ink chamber; 3*a,* an ink holding member; 4*a,* an air through-hole; 5*a,* a tank meniscus member; 6*a,* a joint port; 7*a,* an ink passing member; 11*a,* a print head; 12*a,* a joint pipe; 13*a,* a head meniscus member; 14*a,* an ink supplying path; 15*a,* a head chip; 16*a,* a connector; 21*a,* a jointing member. In FIG. 1, there are illustrated the ink tank and an ink supplying portion as a part of the print head.

The ink chamber 2*a* is provided in the ink tank 1*a*. The housing of the ink tank 1*a* has a rigidity high enough to hold ink therein for a long time. A material sufficiently resistive to ink is used for making the ink tank 1*a*. The joint port 6*a* is formed in the lower side of the ink chamber 2*a*. At the joint port 6*a,* the ink tank is jointed to the print head 11*a*. Ink is supplied from the ink chamber 2*a* to the print head, through the joint, port 6*a*. The bottom surface of the ink chamber 2*a* is slanted to have the deepest part where the joint port 6*a* is formed.

The ink holding member 3*a* is disposed within the ink chamber 2*a*. The ink holding member 3*a* holds ink therein by a capillary force and puts the inside of the print head 11*a* in a negative pressure. A material of the ink holding member 3*a* may be a fiber material having a two-dimensional structure, a porous material having a three-dimensional structure, a material of felt formed by spinning the fiber material in a three-dimensional fashion, an unwoven fabric, or the like. A specific example of the material for the ink holding member is an inner cotton material formed by unidirectionally bundling polyester fiber. The medium cotton may have a density (=weight/volume) of 5% to 15%. Polyester felt formed by three-dimensionally spinning polyester fiber may be used. A preferable density of the polyester felt is within the range between 0.05 g/cm$^3$ to 0.1 g/cm$^3$. Those density values are preferable when considering a capillary force to ink and a fluid resistance to ink. The materials for the ink holding member are not limited to those enumerated above, but may be any materials if those have proper capillary forces and are sufficiently resistive to ink. In the present embodiment, polyester felt of 0.05 g/cm$^3$ in density (when it is put in the main ink chamber) is used.

The air through-hole 4*a* through which the ink holding member 3*a* communicates with the outside air is formed in the upper side of the ink chamber 2*a*. A diameter of the air through-hole 4*a* is larger than the diameter of each perforation of the ink holding member 3*a* or the width of a gap between the adjacent fibers. The upper part of the ink holding member 3*a* communicates with the outside air to be under an atmospheric pressure. In supplying ink to the print head 11*a,* the ink in the ink holding member 3*a* is under the atmospheric pressure, while at the same time is pulled down from the lower side by a negative pressure, and led to the ink passage 5*a* side. Therefore, the ink of the ink holding member can efficiently be used. At this time, the negative pressure in the print head is kept constant by the capillary force of the ink holding member 3*a*. A sheet, which prohibits ink from passing therethrough but allows air to pass therethrough, may be applied to the air through-hole 4*a*. By so doing, no ink flows out of the ink chamber through the air through-hole 4*a*. Alternatively, a number of perforations minute to such an extent as to block the flow of ink therethrough may be provided in the air through-hole 4*a*.

The tank meniscus member 5*a* and the ink passing member 7*a* are disposed in this order in the joint port 6*a* of the ink chamber 2*a*. The bottom of the ink holding member 3*a* is brought into contact or press contact with the tank meniscus member 5*a*. The tank meniscus member 5*a* may be a mesh member of, for example, metal mesh or resin mesh, or a porous member. Specific examples of the mesh member are a metal mesh filter, a filter whose basic material is metal fiber formed in a manner that fine wires of SUS are prepared to be felt, and then sintered, an electroforming metal filter, and the like. Further, a filter as a resin fiber fabric, e.g., tatami twill, or a metallic fabric, and a filter with extremely minute perforations, which is worked by using a laser or electron beam, may be used for the tank meniscus member.

In a state that the ink tank is detached from the print head and left alone, no ink leaks out of the joint port 6*a* since a surface tension of ink in each of the minute perforations of the tank meniscus member 5*a* prevents ink from flowing out of the perforations. In a state that the ink tank 1*a* is attached to the print head, the tank meniscus member 5*a* buffers a vibration of and an impact to the ink tank 1*a,* a pressure variation caused by an acceleration, and blocks the entering of air bubbles from the nozzles or the print head into the ink tank.

The diameter of each minute perforation of the tank meniscus member 5*a* is determined by the characteristics of the ink holding member 3*a* and ink used, and the size of the ink tank 1*a*. The perforation diameter is selected so that even when the ink tank 1*a* is detached from the print head, no ink leaks, and even when the ink tank 1*a* is turned upside down, no air enters the ink tank. The perforation diameter of the tank meniscus member 5*a* is selected to be within 20 $\mu$m to 70 $\mu$m, for example.

The ink passing member 7*a* is disposed in the joint port 6*a* so that it fills a space between the tank meniscus member 5*a* and the head meniscus member 13*a* when the ink tank 1*a* is attached to the print head. In the embodiment, the ink passing member 7*a* is provided in the ink tank 1*a*. Therefore, when the ink tank 1*a* is attached to the print head, it comes in contact with the head meniscus member 13*a*. When the ink passing member 7*a* comes in contact with the head meniscus member 13*a,* the ink tank communicates with the print head, a large force is not required for jointing the ink tank to the print head or the printer. In the embodiment, when the ink passing member 7*a* is brought into contact with the head meniscus member 13*a,* the ink passing member 7*a* is deformed by only about 0 to 0.2 mm.

A material for making the ink passing member 7*a* is preferably a material capable of absorbing ink by a capillary force so that when the ink tank is removed, ink drips from the ink passing member. Preferable materials of the ink passing member 7*a* are a fiber material having a two-dimensional structure, a porous material having a three-dimensional structure, a material of felt formed by spinning the fiber material in a three-dimensional fashion, an unwoven fabric, and the like. A specific example of the material for the ink passing member is polyester felt formed by three-dimensionally spinning polyester fiber. A preferable density of the polyester felt is within the range between 0.01 g/cm$^3$ to 0.4 g/cm$^3$. Those density values are preferable when considering a capillary force to ink and a fluid resistance to ink. The materials for the ink holding member are not limited to the polyester fiber, but may be any materials if those have proper capillary forces and are sufficiently resistive to ink. In the present embodiment, polyester felt of 0.02 g/cm$^3$ in density is used. The thickness of the ink passing member 7*a* when viewed in the ink supplying direction is preferably about 1 mm to 5 mm; in the embodiment, it is approximately 2 mm. It is preferable that the flow resistance of the ink passing member 7*a* is low.

The print head 11*a,* as shown in FIGS. 2B and 2C, is provided with the head chip 15*a,* the joint pipe 12*a,* the connector 16*a,* and the like. The print head 11*a* is secured to the carriage of the printer. If necessary, it may be detachably mounted on the carriage. The head chip 15*a* may be a print head of the thermal ink jet type, a head chip of the piezoelectric type, or the like. The connector 16*a* is electrically connected to the printer body, and supplies an electric power to the head chip 15*a* for causing the head chip to jet ink droplets, and transfers control signals to and from the printer.

In the ink introducing portion of the print head 11*a,* the joint pipe 12*a* stands erect and the ink supplying path 14*a* is placed within the pipe. The head meniscus member 13*a* is placed on the top of the joint pipe 12*a.* A number of minute perforations are formed in the head meniscus member 13*a* as in the tank meniscus-member 5*a.* In a state that the ink tank 1*a* is removed, a surface tension of ink in each minute perforation of the head meniscus member 13*a* blocks air from entering the print head 11*a,* and further prevents ink from leaking through the ink jetting nozzles. Further, it blocks the entering of dusty materials into the ink supplying path 14*a.* In a state that the ink tank 1*a* is attached to the printer, the head meniscus member 13*a* is brought into contact with the ink passing member 7*a.* As a result, it communicates with the ink tank 1*a* and serves as a filter. A material of the head meniscus member 13*a* may be selected from among the already stated materials of the tank meniscus member 5*a.* A grain size of it is preferably within the range of about 5 $\mu$m to 20 $\mu$m.

The jointing member 21*a* is disposed around the joint pipe 12*a.* In attaching the ink tank 1*a* to the print head, the jointing member 21*a* is brought into contact with the face of the joint port 6*a,* to thereby seal the jointing portion. Therefore, no ink will leak from the Jointing portion. The jointing member 21*a* may be made of silicon rubber or butyl rubber, for example. The jointing member 21*a* may be omitted.

Figure 3:
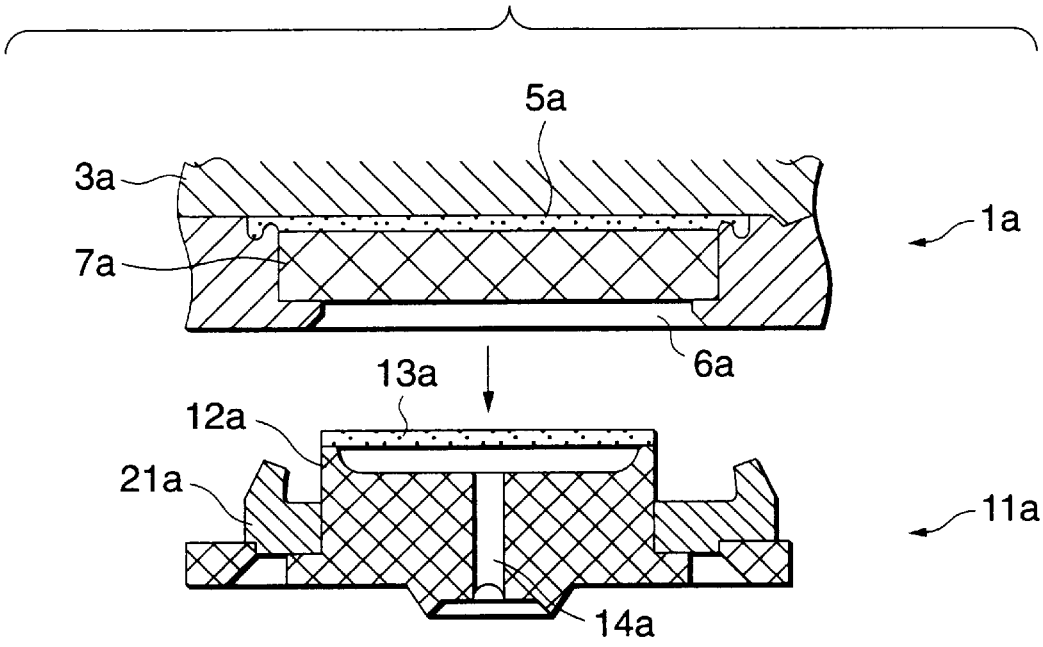
FIG. 3 is an enlarged, cross sectional view showing the joint port and its near portion when the ink tank is detached from the printer.
Figure 4:
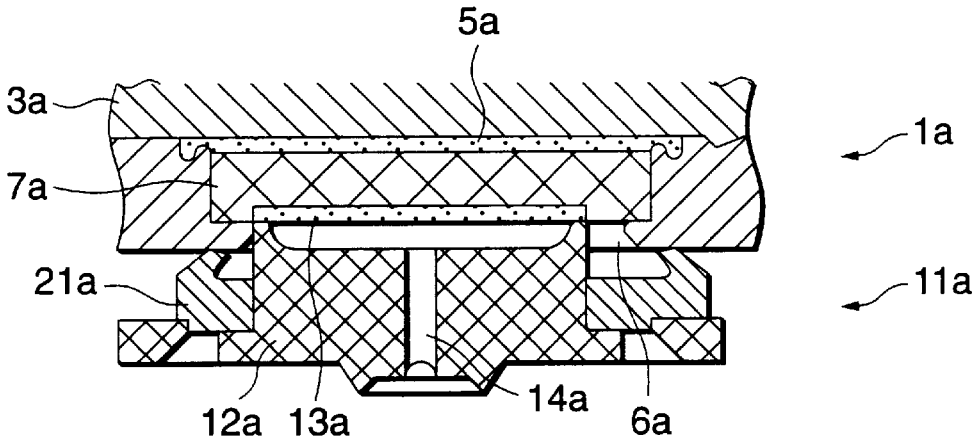
FIG. 4 is an enlarged, cross sectional view showing the joint port and its near portion when the ink tank is attached to the printer.

FIG. 3 is an enlarged, cross sectional view showing the joint port and its near portion when the ink tank is detached from the printer. FIG. 4 is an enlarged, cross sectional view showing the joint port and its near portion when the ink tank is attached to the printer. The ink tank 1*a* is jointed to the print head 11*a* in a state that the joint port 6*a* of the ink tank 1*a* is coupled with the ink introducing portion of the print head 11*a.* As described above, when the ink tank 1*a* is attached to the printer, the ink passing member 7*a* of the ink tank 1*a* is in contact with the head meniscus member 13*a* placed on the top of the joint pipe 12*a,* to thereby form an ink passage. Therefore, little air stays in the jointing portion. Further, when the ink tank 1*a* is attached, little air is introduced into the ink passage. Accordingly, if a little air is left in the air passage, it may be removed by sucking it from the nozzle side in maintenance. Thus, the printing problem owing to the air in the jointing portion is completely solved.

Furthermore, when the ink tank 1*a* is attached to the printer, the jointing member 21*a* of the print head 11*a* is brought into contact with the face of the joint port 6*a* of the ink tank 1*a,* and deformed, so that the jointing portion is sealingly closed to prevent the ink leakage. After the attaching of the ink tank 1*a,* ink flows out of the ink tank 1*a,* and passes through the ink passage of the hermetically closed jointing portion and reaches the print head 11*a.*

When the ink tank 1*a* is removed, the ink passing member 7*a* is separated from the head meniscus member 13*a.* In this state, in the ink tank 1*a* the ink holding member 3*a* holds ink therein by its ink holding force, so that no ink leaks from the ink tank. In the print head 11*a,* the head meniscus member 13*a* holds ink therein by its capillary force. Accordingly, no ink leaks out of the head chip 15*a.* Thus, even when the ink tank 1*a* is removed, the ink leakage does not take place. In a state that the ink tank 1*a* is attached, the ink passing member 7*a* is little deformed. Therefore, when the ink tank 1*a* is removed, it does not take place that the volume of the ink passing member is varied and air enters the air passage.

Figure 5A:
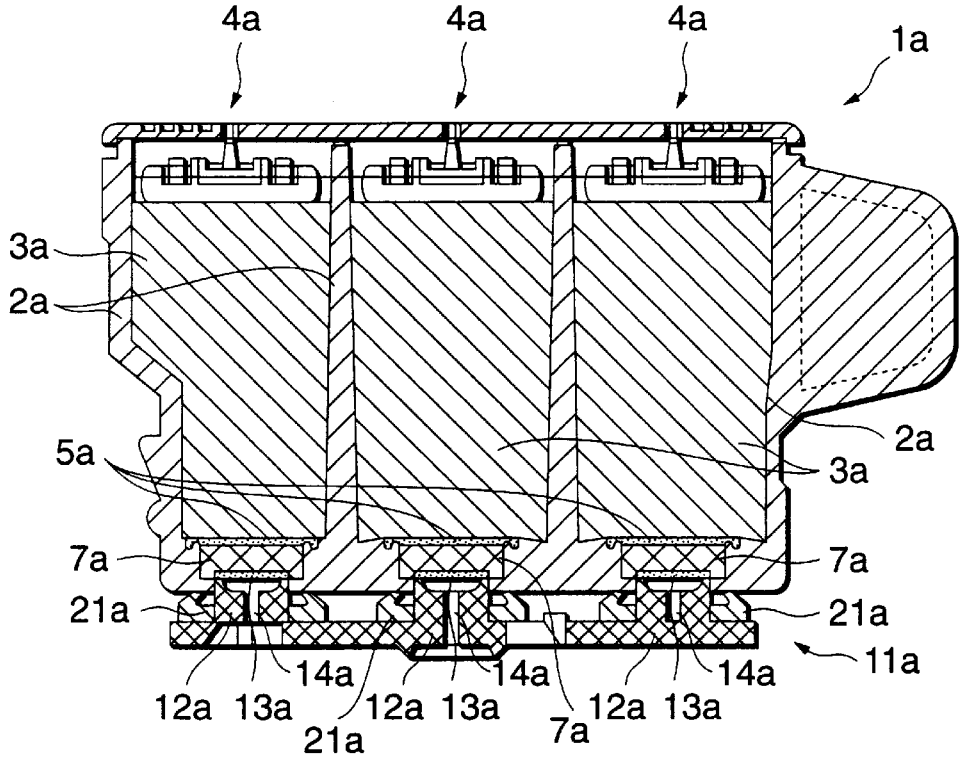
FIGS. 5A and 5B are cross sectional views showing an ink tank having three ink chambers which is another embodiment of an ink tank and a print head according to the present invention.
Figure 5B:
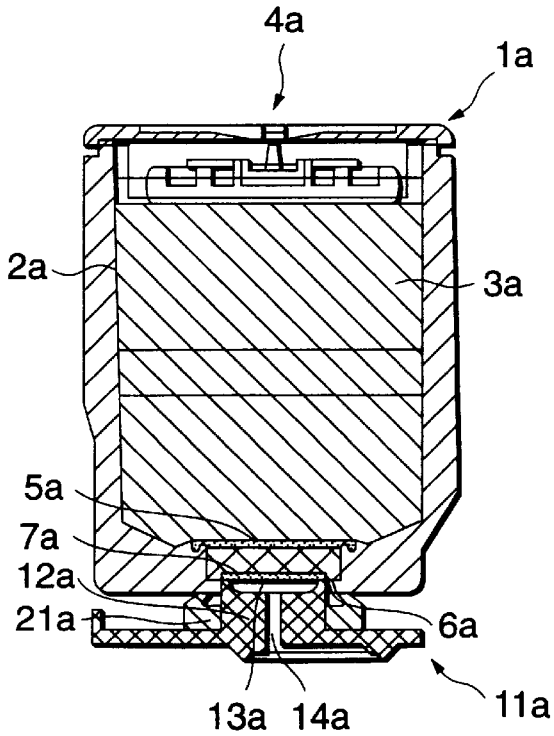

FIGS. 5A and 5B are is a cross sectional view showing an ink tank having three ink chambers which is another embodiment of an ink tank and a print head according to the present invention. In the embodiment, three ink chambers are disposed side by side in the longitudinal direction of the ink tank 1*a.* The structure of each ink introducing portion of the print head 11*a,* which corresponds to each ink chamber, may be the same as of FIGS. 2A, 2B, 2C and 3. Inks contained in the ink chambers are supplied to the print head 11*a.* If inks of cyan, magenta and yellow are contained in the three ink chambers, the ink tank serves as an ink tank of full color. The print head may be provided with head chips for those color inks or a unit type head chip of three colors. The number of ink chambers is not limited to one and three, but may be two, or four or larger, as a matter of course.

Figure 6:
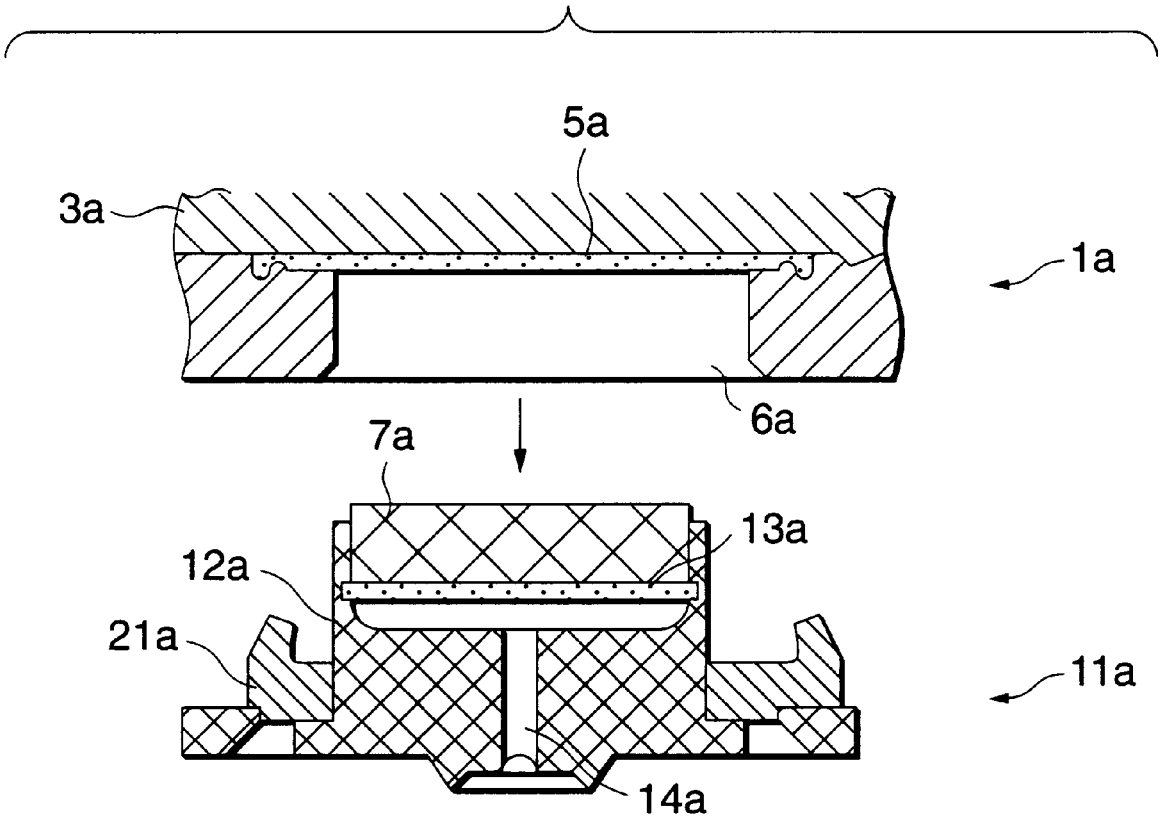
FIG. 6 is an enlarged, cross sectional view showing a jointing portion and its near portion in yet another embodiment of an ink tank and a printer according to the present invention.

FIG. 6 is an enlarged, cross sectional view showing a jointing portion and its near portion in yet another embodiment of an ink tank and a printer according to the present invention. In the figure, like or equivalent portions are designated by like reference symbols in FIGS. 3 and 4. In the present embodiment, the ink passing member 7*a* is included in the print head 11*a,* while it is included in the ink tank in the first embodiment. Also in this jointing structure, the tank meniscus member is brought into contact with the ink passing member 7*a* as shown in FIG. 4, whereby an ink passage is formed. To make a contact of those members, a large pushing force is not required. Also in this embodiment, the space between the tank meniscus member 5*a* and the head meniscus member 13*a* is filled with the ink passing member 7*a.* Therefore, when the ink tank 1*a* is attached, little air stays in the ink passage, and little air enters the ink passage. When the ink tank 1*a* is removed, a variation of the volume of the ink passing member 7*a* does not lead to the entering of air into the ink passage since the ink passing member 7*a* is little elastically deformed.

As seen from the foregoing description, when the ink tank is attached to the printer, a space between the meniscus forming members of the ink tank and the print head is filled with the ink passing member. Therefore, little air stays in the jointing portion, and little air enters the ink passage. It is noted that the meniscus forming member of the ink tank or the print head is made merely to contact with the ink passing member. Accordingly, when those are made to contact with each other, it is not greatly deformed. Therefore, air that is introduced into the ink passing member as the result of the elastic deformation is reduced in its amount, and an amount of air entering the ink passage is reduced. Therefor, it does not take place that the ink flow is interrupted by air staying in the jointing portion, to thereby make it impossible to use ink for printing. Then, ink can efficiently be used. Print picture defect that is due to the air staying in the jointing portion is eliminated. In other words, a print quality is improved.

Figure 7:
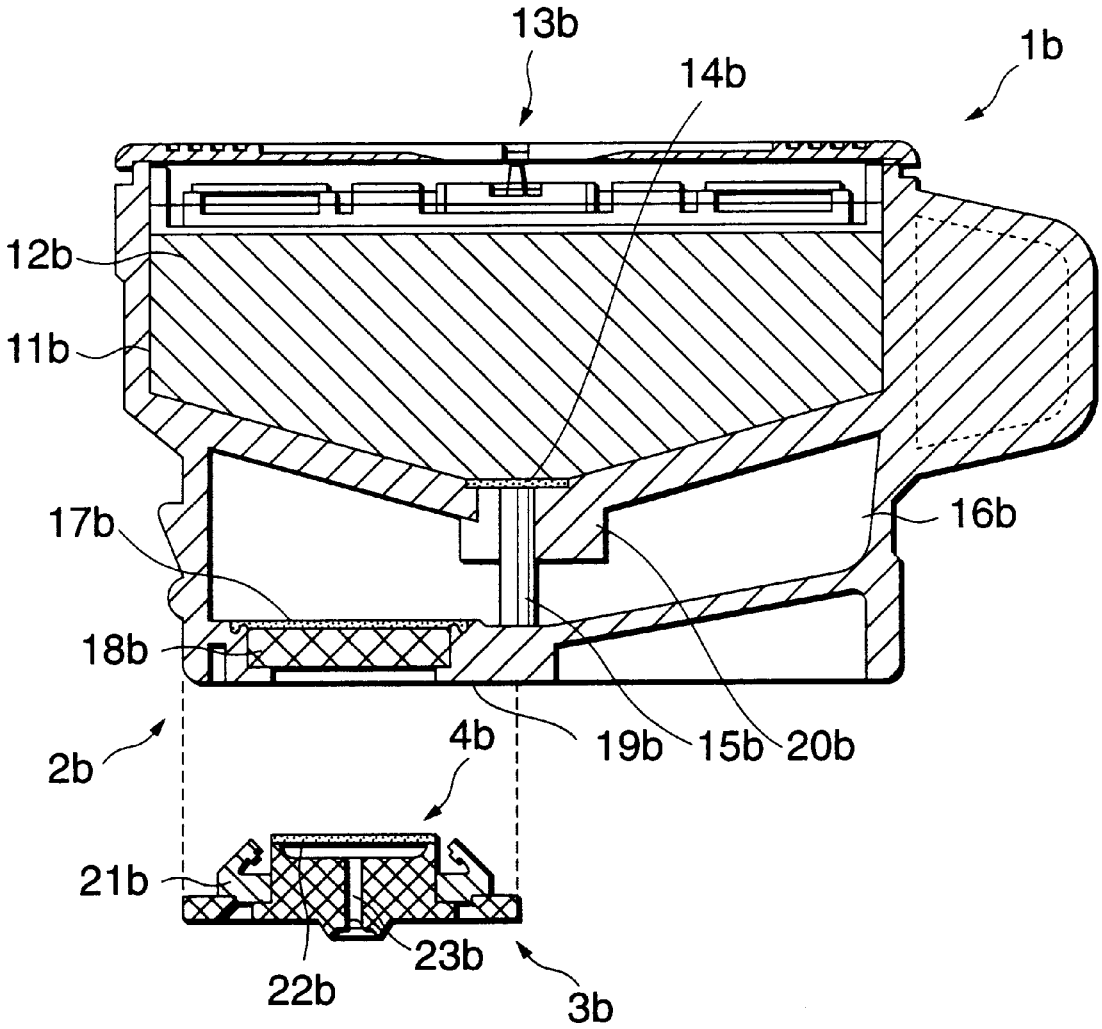
FIG. 7 is a cross sectional view showing a key portion of a first embodiment of a printer and an ink tank according to the present invention.
Figures 8A, 8B:
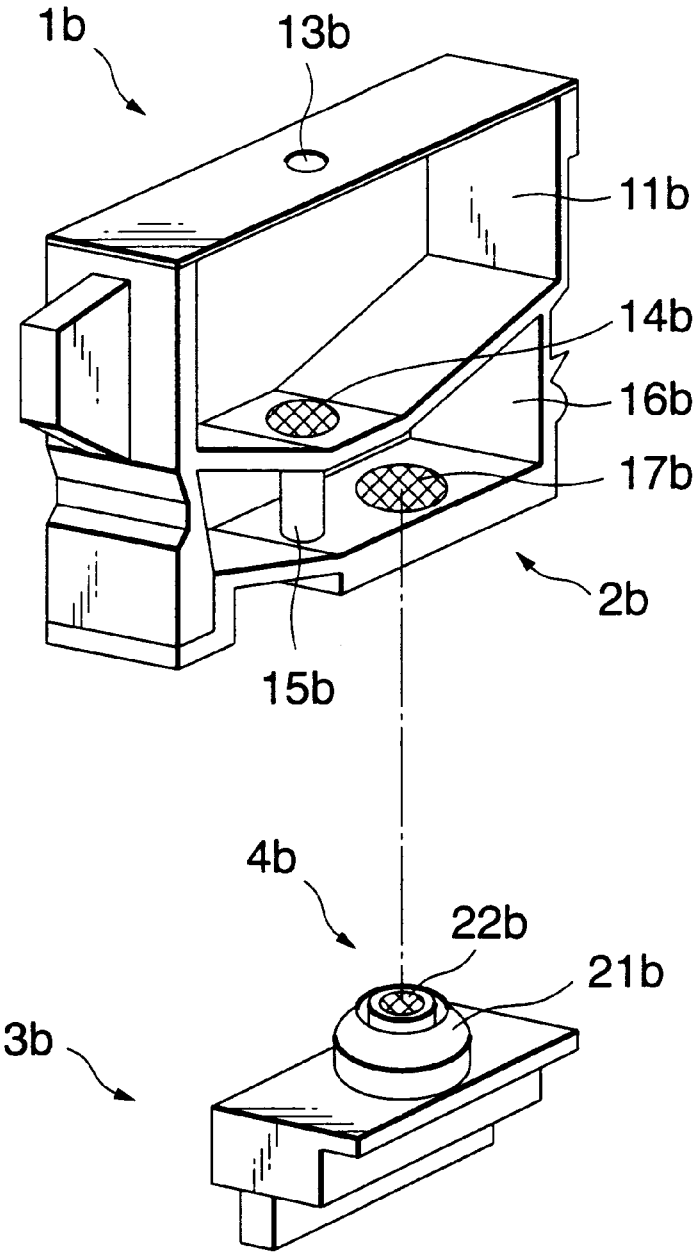
FIGS. 8A and 8B are perspective views showing a key portion of the embodiment of FIG. 7.

FIG. 7 is a cross sectional view showing a key portion of a first embodiment of a printer and an ink tank according to the present invention. FIGS. 8A and 8B perspective views showing a key portion of the embodiment of FIG. 7. In the figure, reference numeral 1*b* designates an ink tank; 2*b,* a jointing part; 3*b,* a print head; 4*b,* ink introducing means; 11*b,* a main ink chamber; 12*b,* an ink chamber capillary member; 15*b,* an ink introducing member; 16*b,* an intermediate chamber; 17*b,* a second meniscus forming member; 18*b,* a jointing-portion capillary member; 19*b,* a joint periphery portion; 20*b,* an ink introducing member holder; 21*b,* a jointing member; 22*b,* a filter; and 23*b,* an ink passage. A state of the construction before the ink tank 1*b* is attached to the printer or the print head 3*b* is illustrated in FIGS. 7, 8A and 8B. In the construction illustrated in those figures, the print head 3*b* is mounted on the printer. The ink tank 1*b* is to be attached to the print head 3*b*. Only an ink passage between the ink tank 1*b* and the print head 3*b* is illustrated. In FIGS. 8A and 8B, the ink tank 1*b* is illustrated in a state that one of the side walls of the ink tank 1*b* and the ink chamber capillary member 12*b* are removed. The ink tank 1*b* is attached to the print head 3*b* by means of the jointing means 2*b* of the ink tank 1*b*. In attaching the ink tank 1*b* to the print head 3*b* or the printer, the jointing means 2*b* of the ink tank 1*b* is brought into contact with the ink introducing means 4*b* to form a passage for ink. Through the ink passage, ink is supplied from the ink tank 1*b* to the print head 3*b*.

The main ink chamber 11*b* is provided in the ink tank 1*b*. The intermediate chamber 16*b* is provided on the underside of the ink tank 1*b*. The ink chamber capillary member 12*b* is located in the main ink chamber 11*b*. The ink chamber capillary member 12*b* holds ink therein by a capillary force, and keeps a negative pressure therein. An air through-hole 13*b* is formed in the upper side of the main ink chamber 11*b*. Through the air through-hole 13*b,* the ink chamber capillary member 12*b* communicates with the outside air. An ink through-hole is formed in the lower side of the main ink chamber 11*b*. Through the through-hole, the main ink chamber 11*b* communicates with the intermediate chamber 16*b*. The ink chamber capillary member 12*b* is opened to the outside air in the upper side thereof. Therefore, in an ink supplying mode, ink is pushed down by the atmospheric pressure. At this time, ink is pulled out, by a negative pressure, to the intermediate chamber 16*b,* from the lower side of the ink chamber capillary member 12*b*. The bottom surface of the main ink chamber 11*b* is slanted so as to form the deepest part. The through-hole allowing the main ink chamber 11*b* to communicate with the intermediate chamber 16*b* is formed in the deepest part.

A first meniscus forming member 14*b* having a number of minute perforations is placed in the through-hole of the bottom surface of the main ink chamber 11*b*. The bottom end of the ink chamber capillary member 12*b* is put on the first meniscus forming member 14*b* in a state that the former is pressed against on the latter. When the ink chamber capillary member 12*b* is impregnated with ink, ink moves to the intermediate chamber 16*b* through the first meniscus forming member 14*b*. When ink of the ink chamber capillary member 12*b* is used up, ink pushes the menisci of ink in the minute perforations of the first meniscus forming member 14*b* which is in contact with the ink chamber capillary member 12*b,* and overcomes the surface tension of each minute perforation, and moves as air bubbles into the intermediate chamber 16*b*. Through this action, the ink supplying pressure for supplying ink to the print head 3*b* is kept at a predetermined value or smaller.

The ink introducing member 15*b* is placed under the first meniscus forming member 14*b*. The ink introducing member 15*b* is supported by the ink introducing member holder 20*b,* which is protruded downward (when seen in the drawing) from the peripheral wall of the through-hole of the bottom wall of the main ink chamber. Alternatively, a part of the first meniscus forming member 14*b* may be used as the ink introducing member 15*b*. The ink introducing member 15*b* may be extended up to the bottom surface of the intermediate chamber 16*b*. When air bubbles stay on the lower surface of the first meniscus forming member 14*b* to form an air layer thereon, or when the liquid surface level of ink in the intermediate chamber 16*b* lowers, the ink introducing member 15*b* sucks up ink in the intermediate chamber 16*b* and supplies ink to the first meniscus forming member 14*b*. Therefore, the first meniscus forming member 14*b* is kept wet and keeps a negative pressure. Further, the ink supplying pressure can be kept at an optimum value till ink is used up.

The intermediate chamber 16*b* has a portion located above the through-hole. In FIG. 7, the upper wall of the intermediate chamber 16*b* is slanted upward so that the peripheral portion of the intermediate chamber 16*b* is located above the through-hole. Air bubbles entering the intermediate chamber 16*b* through the first meniscus forming member 14*b* and the second meniscus forming member 17*b* are collected to the higher peripheral portion than the through-hole. The thus constructed intermediate chamber prevents the air bubbles from moving from the jointing means 2*b* to the print head 3*b,* and removes air staying in a jointing portion.

The jointing means 2*b* is provided at the bottom of the intermediate chamber 16*b*. The jointing means 2*b* includes the second meniscus forming member 17*b* having a number of minute perforations and the jointing-portion capillary member 18*b*. Those members are located in this order or the former is located on the latter. In a state that the ink tank 1*b* is removed and left alone, the surface tension of ink of the minute perforations of the second meniscus forming member 17*b* prevents ink from leaking from the intermediate chamber 16*b* through the jointing means 2*b*. In a state that the ink tank 1*b* is attached to the printer, the jointing means buffers a vibration of the ink tank, an impact to the ink tank, a pressure variation caused by an acceleration, and lessens the entering of air bubbles from the nozzle of the print head 3*b* into the air passage. The second meniscus forming member 17*b* may be a mesh filter of 40 $\mu$m in grain size and made of stainless steel.

When the ink tank 1*b* is attached to the printer, the jointing-portion capillary member 18*b* is inserted between the second meniscus forming member 17*b* and the filter 22*b* of the print head 3*b*. Therefore, air left in the jointing portion is remarkably reduced, and print defects are reduced. When the ink tank 1*b* is detached from the printer, the jointing-portion capillary member 18*b* absorbs ink, so that ink does not fall in drops. If an amount of ink exceeds an ink holding tolerable value of the jointing-portion capillary member 18*b,* the amount of ink in excess of the tolerable value is sucked into the ink tank 1*b* through the action of the negative pressure in the ink tank 1*b*. And the jointing-part capillary member 18*b* holds a predetermined amount of ink. At this time, the volume of the jointing-portion capillary member 18*b* is little varied although it is varied in the conventional art. Therefore, little air enters the jointing-portion capillary member 18*b*.

A material of good ink absorption is used for the jointing-portion capillary member 18*b* is made of a material of good ink absorption, for example, fiber felt easy to manufacture. The felt may be made of polyester, acryl, polypropylene or the like. The felt is advantageous in that it has good wetting properties, and its density may be changed as desired.

A density of the jointing-portion capillary member 18*b* is selected to be higher than that of the ink chamber capillary member 12*b* filling the main ink chamber 11*b*. By so doing, when the ink tank 1*b* is detached from the printer, no ink drips. When the density of the jointing-portion capillary member 18*b* is approximately two times as high as of the ink chamber capillary member 12*b*, a smooth supply of ink is ensured, and no problem arises in the suction operation at the time of maintenance. To minimize a pressure loss, it is desirable that the jointing-portion capillary member 18*b* is as thin as possible. However, selection of the thickness of the jointing-portion capillary member 18*b* in consideration of its contact with the filter 22*b* of the print head 3*b* will do. The thickness of the jointing-portion capillary member 18*b* is preferably 2 to 5 mm.

The joint periphery portion 19*b* of the jointing means 2*b* has a flat face so that the jointing member 21*b* of the print head 3*b* is easily brought into contact with the joint periphery portion.

The print head 3*b* is jointed to the ink tank 1*b* such that the ink introducing part 4*b* of the print head 3*b* is coupled with the jointing part 2*b*. The jointing member 21*b* is disposed around the ink introducing part 4*b*. In attaching the ink tank 1*b* to tho print head 3*b*, the jointing member 21*b* is brought into contact with the flat face of the joint periphery portion 19*b*, to thereby seal the jointing portion. Therefore, no ink will leak from the jointing portion. The jointing member 21*b* may be made of silicon rubber or butyl rubber, for example. The jointing member 21*b* may be omitted.

The filter 22*b* is placed on the top of the ink introducing part 4*b*. In a state that the ink tank 1*b* is detached from the printer, dusty material sticks onto the ink introducing part 4*b*. The filter 22*b* is provided for preventing such dusty material from entering the ink passage 23*b*. The filter 22 holds ink therein by the menisci formed in the minuter perforations of the filter 22*b*, to thereby prevent ink from flowing out of the nozzles. The filter 22*b* may be constructed with a mesh filter of 5 $\mu$m to 60 $\mu$m in grain size and made of stainless steel. A ceramic filter may be used in place of the mesh filter. A specific example of the filter 22*b* is a stainless mesh filter of 20 $\mu$m in grain size.

Figure 9:
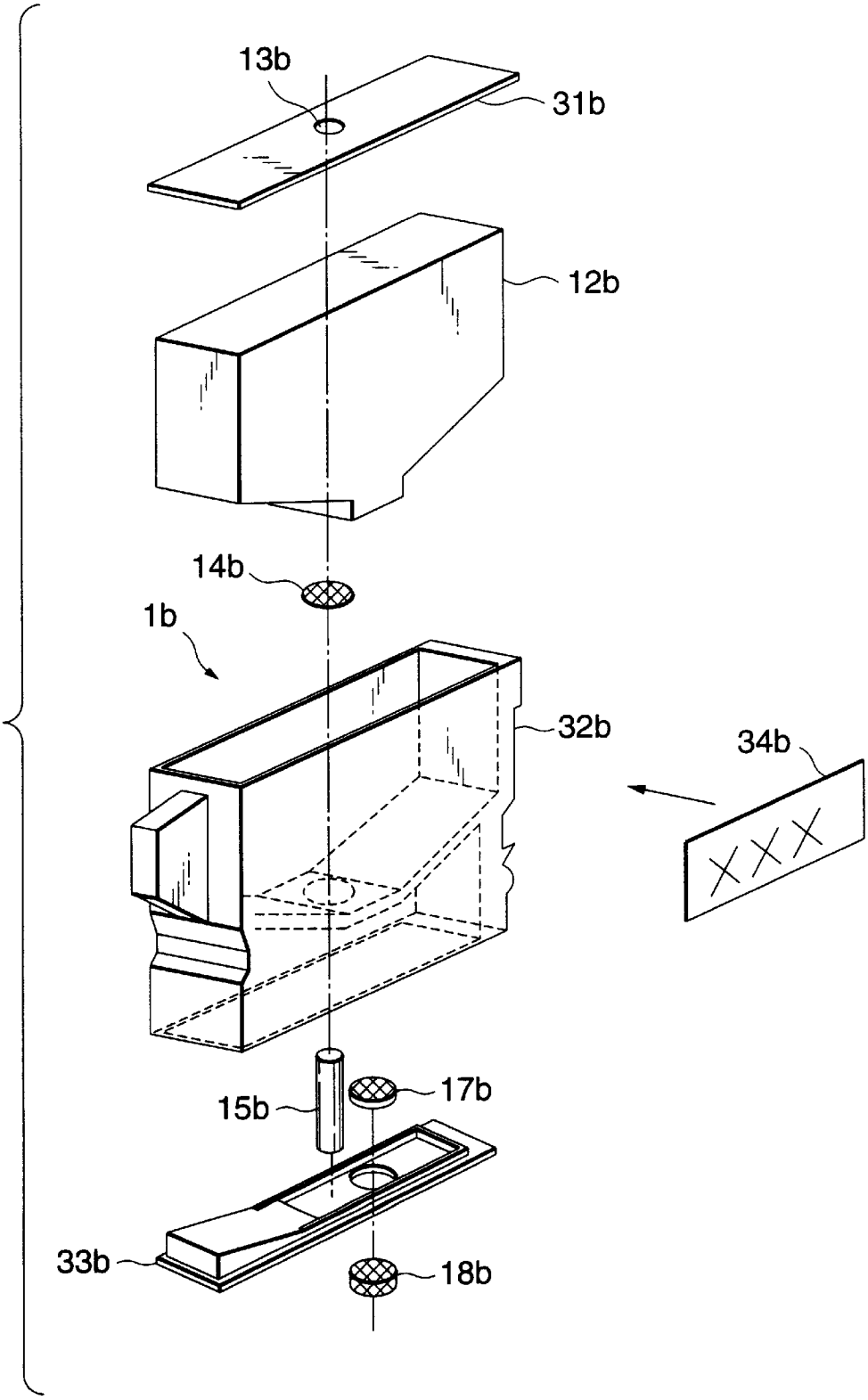
FIG. 9 is an exploded view showing the ink tank 1 used in the first embodiment.

FIG. 9 is an exploded view showing the ink tank 1*b*. In the figure, like or equivalent portions are designated by like reference symbols in FIG. 7. Reference numeral 31*b* designates a top cover 31*b*; 32*b*, a tank case; 33*b*, a bottom cover; and 34*b*, a label. The ink tank 1*b* is formed with the top cover 31*b*, the tank case 32*b* and the bottom cover 33*b*. The tank case 32*b* defines the side plane and the bottom plane of the main ink chamber 11*b*, and the top plane and the side plane of the intermediate chamber 16*b* in FIG. 7. The through-hole, which interconnects the main ink chamber 11*b* and the intermediate chamber 16*b*, is formed in the bottom plane of the tank case 32*b*. The first meniscus forming member 14*b* is disposed in the through-hole. The ink chamber capillary member 12*b* is inserted into the tank case 32*b*. The top cover 31*b* having the air through-hole formed therein is put on the tank case 32*b*, to thereby form the main ink chamber 11*b*. The ink introducing member 15*b* is provided under the first meniscus forming member 14*b*, and the bottom cover 33*b* is located under the ink introducing member 15*b*, whereby the intermediate chamber 16*b* is formed. The bottom cover 33*b* is provided with the jointing part 2*b*. The second meniscus forming member 17*b* and the jointing-portion capillary member 18*b* are disposed in the jointing part 2*b*. The label 34*b* may be bonded to the side wall of the tank case 32*b*. Necessary information may be described on the label.

Figure 10:
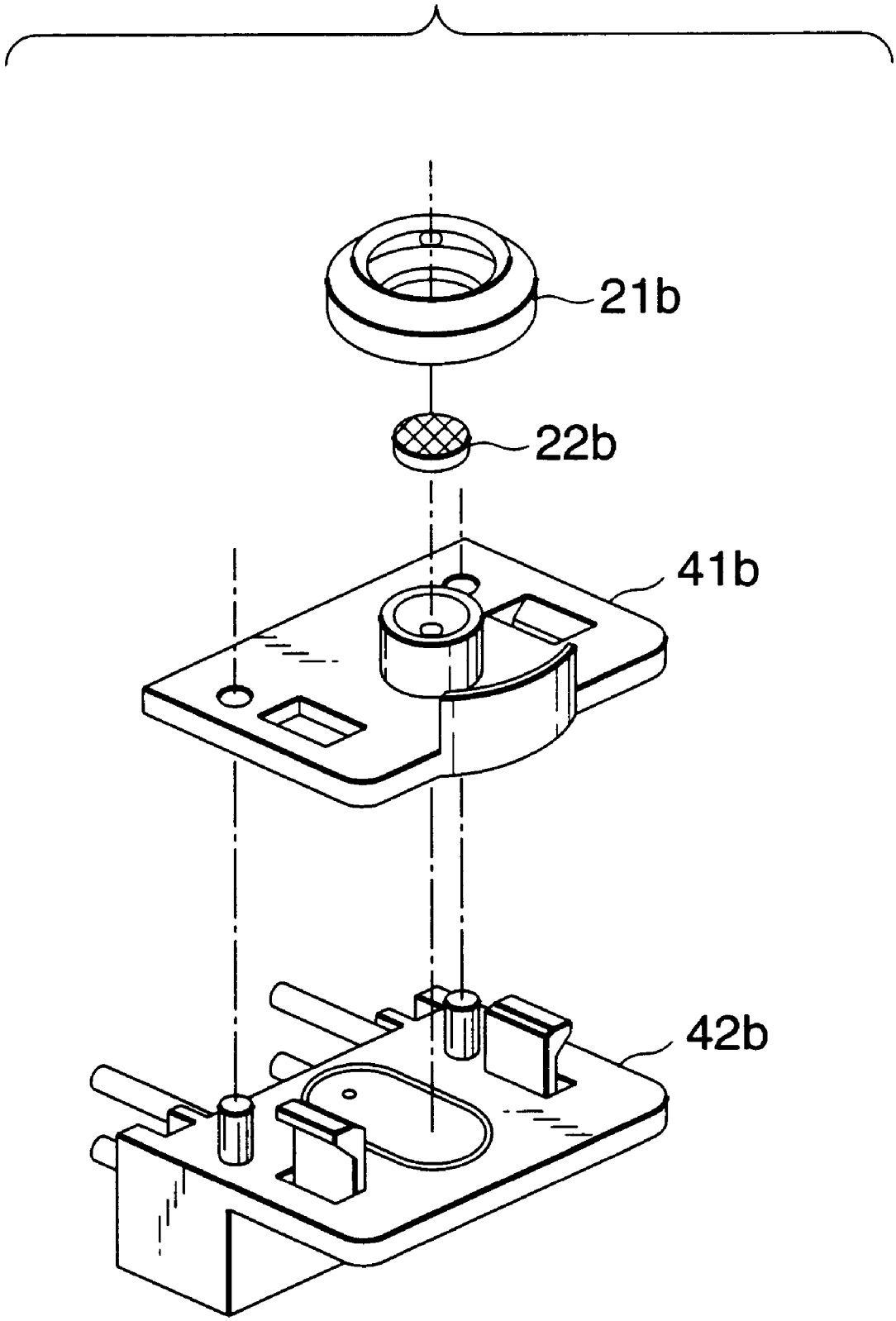
FIG. 10 is an enlarged, exploded view showing the ink introducing means of the first embodiment.

FIG. 10 is an enlarged, exploded view showing the ink introducing part 4*b*. In the figure, like or equivalent portions are designated by like reference symbols in FIGS. 8A and 8B. Reference numeral 41*b* designates a joint block, and 42*b*, a manifold. As described above, the ink introducing means 4*b* includes the jointing member 21*b* and the filter 22*b*. The filter 22*b* and the jointing member 21*b* are assembled into the joint block 41*b*, to thereby form a joint block assembly. The manifold 42*b* is coupled with a head chip having nozzles for discharging ink. Heating elements are provided on the head chip in association with the nozzles. The heating elements generate air bubbles for discharging ink. The joint block assembly is mounted on the manifold 42*b*, to thereby form a major portion of the print head 3*b*. A printed board is further assembled into the print head 3*b*. The board includes wires for supplying electric power and control signals to the head chip assembled into the manifold 42*b*, and a drive circuit for driving the heating elements in accordance with image signals representative of an image to be printed.

Figure 11:
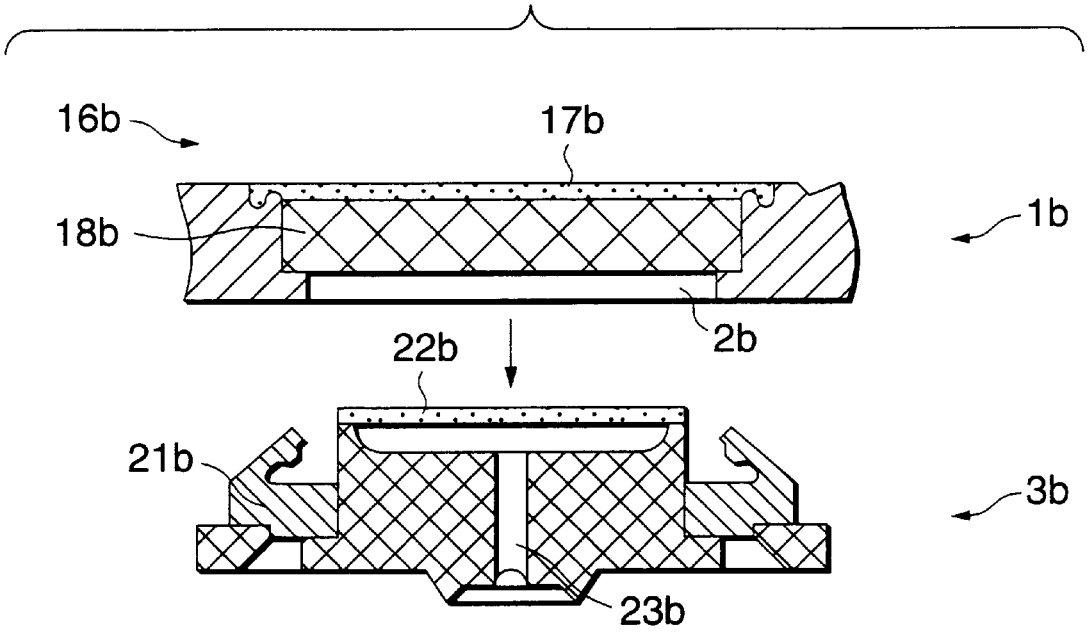
FIG. 11 is an enlarged, cross sectional view showing the jointing means and its near portion when the ink tank is detached from the printer.
Figure 12:
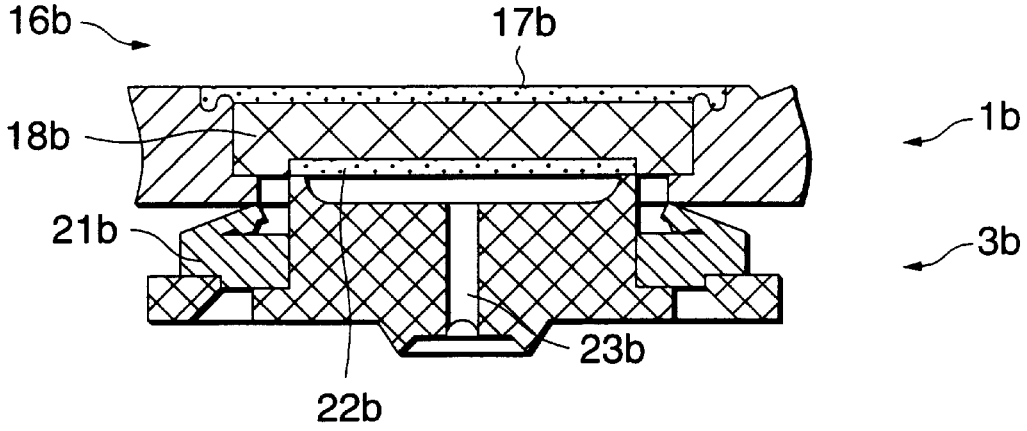
FIG. 12 is an enlarged, cross sectional view showing the jointing means and its near portion when the ink tank is attached to the printer.

FIG. 11 is an enlarged, cross sectional view showing the jointing part and its near portion when the ink tank is detached from the printer. FIG. 12 is an enlarged, cross sectional view showing the jointing means and its near portion when the ink tank is attached to the printer. In the figure, like or equivalent portions are designated by like reference symbols in FIG. 7. To attach the ink tank 1*b* to the printer, as shown in FIG. 12, the jointing-portion capillary member 18*b* of the jointing part 2*b* is brought into contact with the filter 22*b* of the ink introducing part 4*b*, whereby ink is supplied to the print head 3*b*. In this case, a mere contact of the jointing-portion capillary member 18*b* with the filter 22*b* will do. In other words, there is no need of making a press contact of them. When those components parts are brought into contact with each other, the jointing-portion capillary member 18*b* is actually deformed. However, a quantity of the deformation of the member is extremely small, approximately 0.3 to 0.5 mm. The ink supplying capability is little affected by the deformation, or stable.

The jointing member 21*b*, which is disposed around the ink introducing part 4*b*, is brought into press contact with the flat face of the joint periphery portion 19*b* in a state that the top end of the jointing member 21*b* is elastically deformed. In this state, the ink passage is hermetically sealed with the jointing member. Ink in the ink tank 1*b* passes through the jointing-portion capillary member 18*b* being compressed and goes to the print head 3*b*. At this time, the jointing-portion capillary member 18*b* serves as an ink passage located between the second meniscus forming member 17*b* and the filter 22*b*.

Since the ink passage exists in the jointing part 2*b* as described above, ink is present in this portion. When the ink tank 1*b* is detached from the printer as shown in FIG. 11, usually, ink present in the jointing part 2*b* will flow to the peripheral portion of the jointing part 2*b*. The jointing-portion capillary member 18*b*, disposed in the jointing means 2*b*, holds the ink in the jointing part 2*b*. Therefore, the ink left in the jointing part 2*b* will never leak out of the jointing means 2*b*. In the print head 3*b*, a surface tension of ink in the nozzle from which ink is discharged is balanced with a surface tension of the meniscus of ink formed in the minute perforations of the filter 22*b*. Therefore, no ink leaks out of the nozzle, for example.

When the ink tank 1*b* is attached to the printer as shown in FIG. 12, the jointing-portion capillary member 18*b* comes in contact with the filter 22*b*, and the ink passage in the jointing portion is secured by the jointing-portion capillary member 18*b*. Therefore, the amount of ink left in the jointing portion is reduced. As a result, the print defects caused by air bubbles is reduced in number, and the print quality is improved. If air is left in the jointing portion, it can sufficiently be removed by sucking it at the time of maintenance.

In a state that the ink tank 1*b* is separated from the printer as shown in FIG. 11, the jointing-portion capillary member 18*b* is exposed to the outside air and ink will evaporate. However, the evaporation of ink can be prevented in a manner that the jointing part 2*b* is sealed with something or covered with a cap at the factory before it is delivered.

Figure 13:
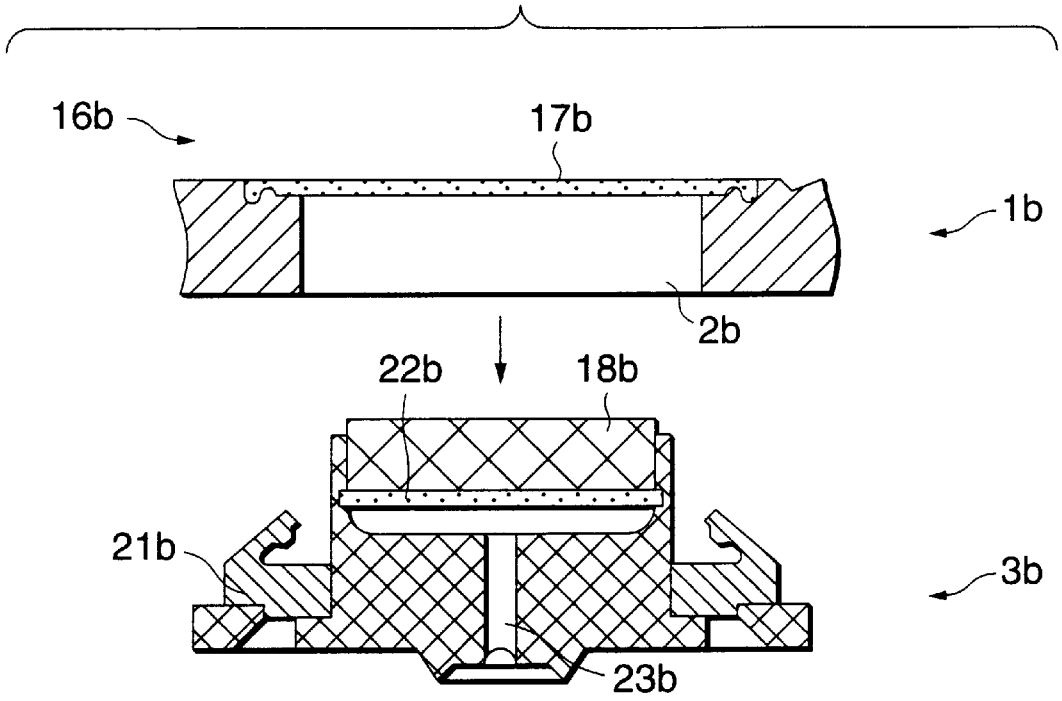
FIG. 13 is an enlarged, cross sectional view showing a jointing means and a portion near it in a second embodiment of a printer according to the present invention.

FIG. 13 is an enlarged, cross sectional view showing a jointing means and its near portion in a second embodiment of a printer according to the present invention. In the figure, like or equivalent portions are designated by like reference symbols in FIG. 7. In the present embodiment, the jointing-portion capillary member 18*b* is included in the print head 3*b*, while it is included in the ink tank in the first embodiment. Also in this jointing structure, the jointing-portion capillary member 18*b* can be brought into contact with the second meniscus forming member 17*b* as shown in FIG. 12. When those are made to contact with each other, the space between the second meniscus forming member 17*b* of the ink tank 1*b* and the filter 22*b* of the print head 3*b* is filled with the jointing-portion capillary member 18*b*. Therefore, the number of the print defects that will be caused by air bubbles is reduced, and the print quality is improved.

When the ink tank 1*b* is removed, no ink leaks from the jointing part 2*b* because a negative pressure of the ink chamber capillary member 12*b* in the ink tank 1*b* is balanced with the surface tension of menisci of the minute perforations of the second meniscus forming member 17*b*. Ink that is present in the jointing portion does not flow out of the ink introducing means 4*b* since the ink is held by a capillary force of the jointing-portion capillary member 18*b*.

Figure 14:
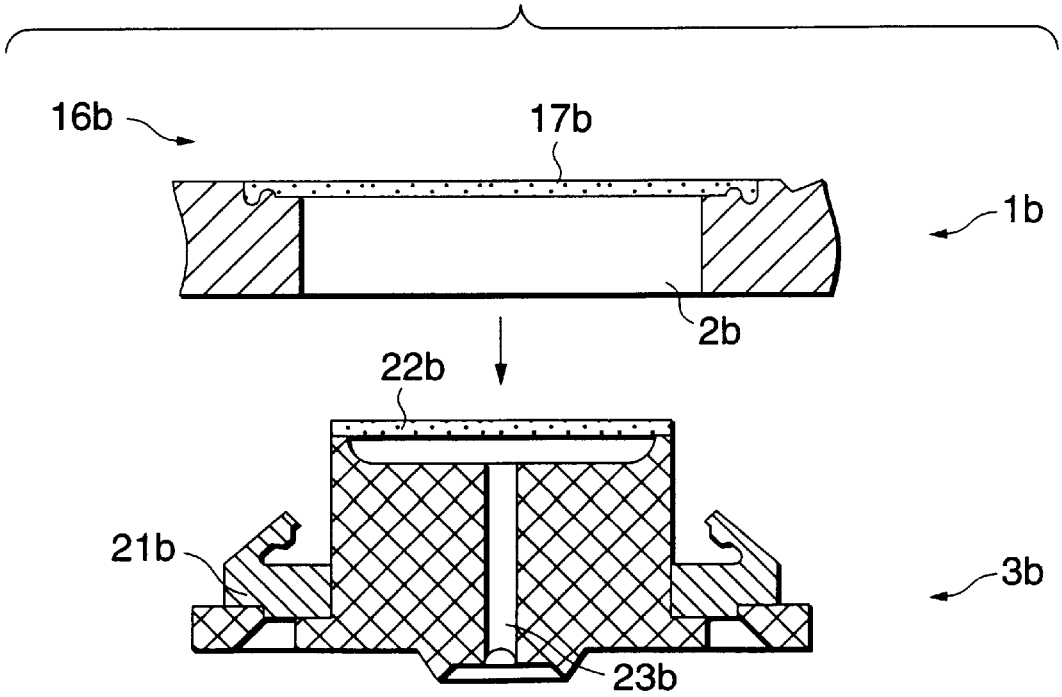
FIG. 14 is an enlarged, cross sectional view showing a jointing mean and its near portion in a third embodiment of a printer according to the present invention.

FIG. 14 is an enlarged, cross sectional view showing a jointing means and its near portion in a third embodiment of a printer according to the present invention. In the figure, like or equivalent portions are designated by like reference symbols in FIG. 7. In the present embodiment, the jointing-portion capillary member 18*b* is not used. Also in this jointing structure, the second meniscus forming member 17*b* of the ink tank 1*b* is made to directly contact with the filter 22*b* of the print head 3*b*, to thereby form an ink passage.

Also in the jointing structure, when the ink tank 1*b* is attached to the printer, the second meniscus forming member 17*b* is made to contact with the filter 22*b*. As a result, air staying in both the component parts is reduced, to thereby reduce the number of the print defects that will occur. Also when the ink tank 1*b* is detached from the printer, no ink will leak out of the jointing part 2*b* as in the second embodiment. In the present embodiment, the jointing-portion capillary member 18*b* may be substituted for the second meniscus forming member 17*b*. As a matter of course, the second meniscus forming member 17*b* is not used.

Figure 15:
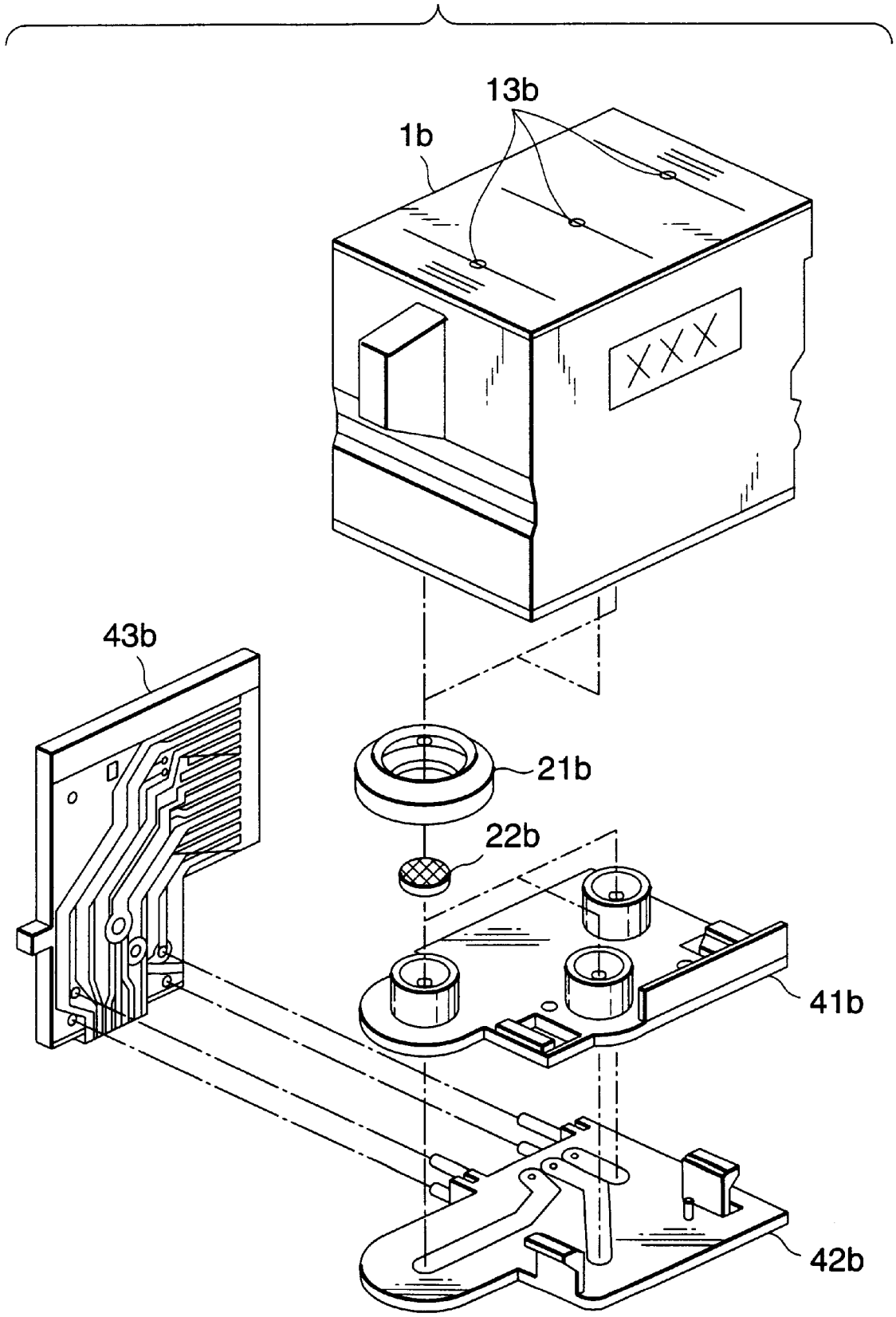
FIG. 15 is an enlarged, cross sectional view showing a jointing means and its near portion in a fourth embodiment of a printer according to the present invention.

FIG. 15 is an enlarged, cross sectional view showing a jointing means and its near portion in a fourth embodiment of a printer according to the present invention. In the figure, like or equivalent portions are designated by like reference symbols in FIGS. 7 to 10. Reference numeral 51*b* designates a printed circuit board 5*b* and 52*b*, a head chip. In the present embodiment, the present invention is applied to a color printer using a plural number of color inks. In this embodiment, inks of three colors are used. The inside of the ink tank 1*b* is divided into three sections so as to supply three color inks. Colors used are cyan, magenta and yellow in the embodiment. If required, other colors may be used instead. The number of ink colors may be four colors including black, only two colors or five or larger number of colors. In this case, the inside of the ink tank may be divided into the number of sections, which is equal to the number of ink colors. As a matter of course, the number of ink tanks equal to tho number of ink colors may be used, while being arrayed side by side.

The inside of the ink tank 1*b* is divided into three sections which contain inks of different colors, respectively. The structure of each section is the same as of the ink tank shown in FIGS. 7 and 10. Those sections each having the structure shown in FIGS. 7 and 10 are coupled together into a single unit. The jointing part 2*b* are provided in association with the divided sections, respectively. In the embodiment, three jointing part 2*b* are arrayed in a zig-zag fashion. The jointing-portion capillary member 18*b* is provided in each jointing means 2*b*, as in the first embodiment. It is evident that the structures of the second and third embodiments may be used for the present embodiment.

The print head 3*b* is illustrated in an exploded fashion. The joint block 41*b* is provided with three ink introducing part 4*b*, which are to be coupled with the color ink tanks. As in the structure shown in FIG. 10, each ink introducing part 4*b* includes a filter 22*b* and a jointing member 21*b*. A joint periphery portion 19*b* of each of the three jointing means 2*b* is pressed against the jointing member 21*b* of the corresponding ink introducing part 4*b*, so that the top end of the jointing member 21*b* is deformed to seal the jointing portion. The jointing-portion capillary member 18*b* of each of the jointing part 2*b* is brought into contact with the filter 22*b* of the corresponding to the ink introducing part 4*b*, to thereby form a passage of the corresponding color ink.

The manifold 42*b* includes ink passages of the color inks formed therein. The manifold 42*b* is communicatively connected to the head chip 52*b* by ink passages. Through the ink passages, color inks are supplied from the ink introducing means 4*b* to the head chip 52*b*.

Various wires are formed on the printed circuit board 51*b*. Electric power and control signals, image signals representative of an image to be printed are supplied to the head chip 52*b*, through those wires on the printed circuit board 51*b*. A drive circuit for driving heating elements in accordance with an image to be printed is often formed on the printed circuit board. The printed circuit board 51*b* and the head chip 52*b* are electrically interconnected by wire bonding, for example.

Figure 16:
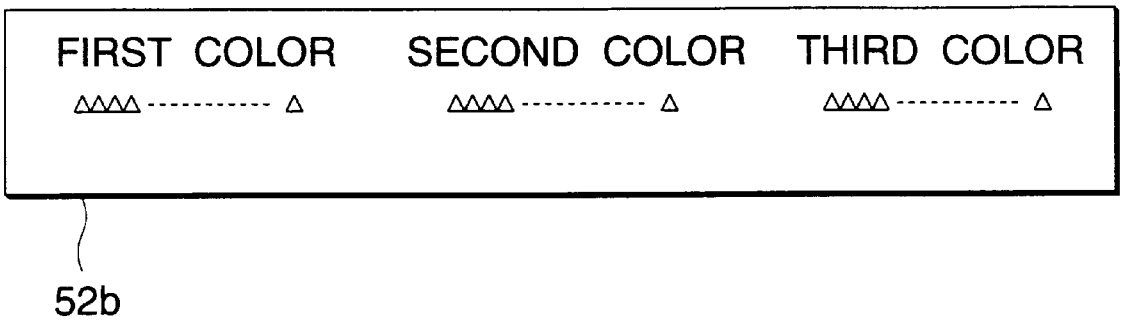
FIG. 16 is a front view showing a head chip used in the fourth embodiment of the present invention.

FIG. 16 is a front view showing a head chip used in the fourth embodiment of the present invention. Groups of nozzles for jetting color inks are formed in the head chip. In this instance, those groups of nozzles for jetting the color inks are linearly arrayed on the head chip. In a printing operation, the head chip 52*b* is vertically moved while jetting color inks, whereby zonal areas of the colors are printed. Sometimes, a drive circuit for driving the nozzles is formed on the head chip 52*b*. In the illustrated head chip, the groups of nozzles are spaced from each other. In some actual head chips, dummy nozzles are located in the spaces each between the adjacent nozzle groups, and on both sides of the linear array of the nozzle groups.

In the fourth embodiment, when the ink tank 1*b* is detached from the printer, the color ink that is left in each ink introducing part 4*b* and a portion near it is held by the jointing-portion capillary member 18*b*. Therefore, the problems of the ink leakage and the dripping of ink are successfully solved. Further, it will never happen that a color ink to be introduced by an ink introducing part 4*b* enters another ink introducing part 4*b* to be mixed with another color ink of the latter. Additionally, a remarkably reduced amount of air bubbles will enter the ink passage when the ink tank 1*b* is attached again to the printer since when the ink tank 1*b* is detached from the printer, the jointing-portion capillary member 18 does not take in air. Furthermore, the amount of air bubbles that will enter the ink passage is further reduced since when the ink tank 1*b* is attached to the printer, the ink passage of the jointing portion is filled with the jointing-portion capillary member 18*b*.

Figure 17:
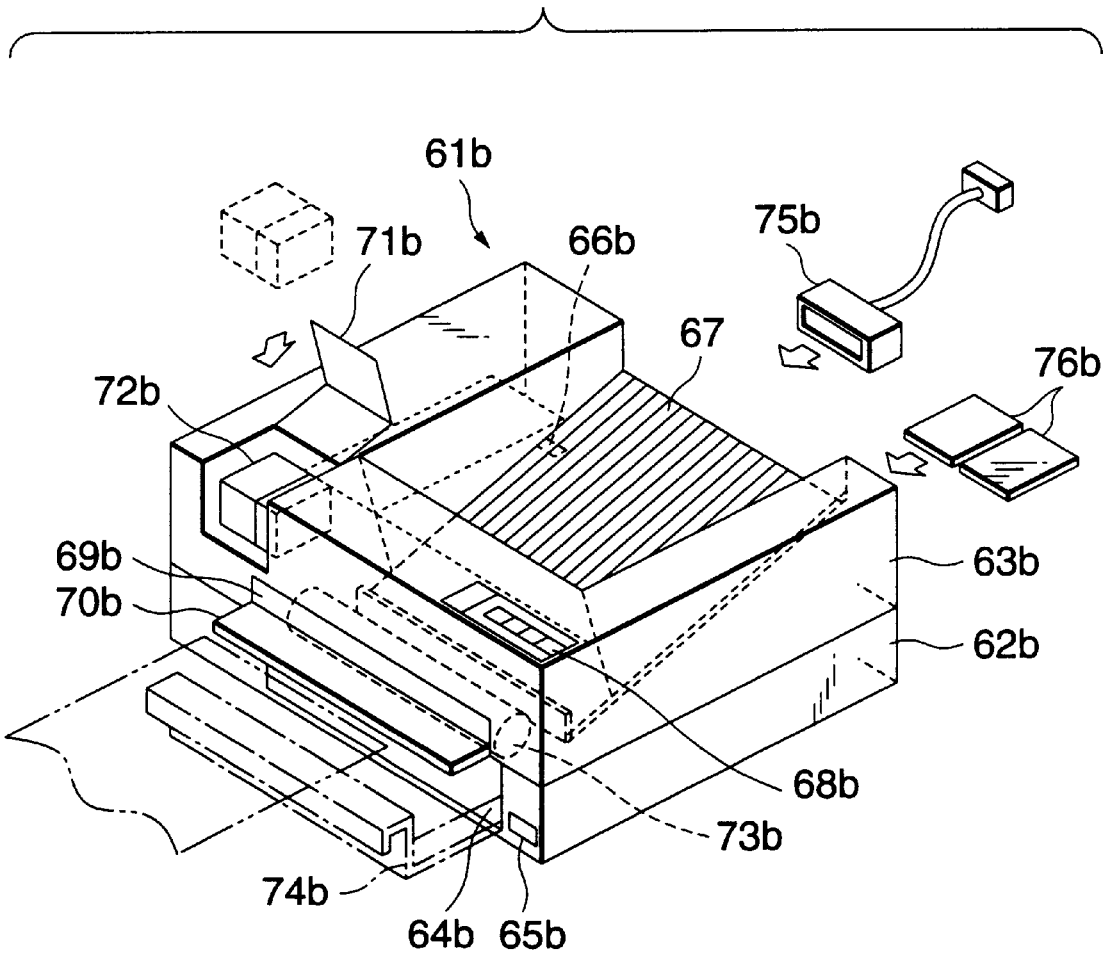
FIG. 17 is a perspective view showing an external appearance of a printer according to the present invention.

FIG. 17 is a perspective view showing an external appearance of a printer according to the present invention. In the figure, reference numeral 61*b* designates a printer; 62*b*, a lower case; 63*b*, an upper case; 64*b*, a tray entering port; 65*b*, a dip switch; 66*b*, a main switch; 67*b*, a paper receptacle; 68*b*, a panel console; 69*b*, a manual insertion port; 70*b*, a manual insertion tray; 71*b*, an ink tank insertion cover; 72*b*, an ink tank; 73*b*, a paper feeding roller; 74*b*, a paper tray, 75*b*, an interface cable; and 76*b*, a memory card. The printer shown in FIG. 11 can accept any of the jointing structures according to the first to fourth embodiments mentioned above.

A case of the printer 61*b* consists mainly of the lower case 62*b* and the upper case 63*b*. Electric circuits and drive system parts, not shown, are contained in the case. The lower case 62*b* includes the tray entering port 64*b* formed therein. Through the tray entering port, the paper tray 74*b* containing print papers therein is inserted into the printer 61*b*, and print papers are fed sheet by sheet to the printer.

The lower case 62*b* includes the dip switch 65*b* and the main switch 66*b*. The dip switch 65*b* is provided for setting some of operations of the printer 61*b*. Those operations set by the switch are infrequently used. When the dip switch 65*b* is not used, it is covered with a cover. The main switch 66*b* is for turning on and off an electric power source for the printer 61*b*. The lower case 62*b* further includes an interface connector, not shown, and an insertion portion through which the memory card 76*b* is inserted. The interface cable 75*b* is connected to the interface connector, whereby data is transferred to and from an external computer, for example. The memory card 76*b* is used as an extension memory when the printer 61*b* is operated. In some printers, it stores fonts, and is used when a printing operation is performed.

The paper receptacle 67*b* of the upper case 63*b* receives printed papers discharged from the printer. The panel console 68*b* is used when a user sets a print mode, and instructs the supplying of print papers and the discharging of papers. The panel console 68*b* is provided with input means frequently used by the user, display means for displaying messages issued by the printer, and the like. The panel console 68*b* further includes manual insertion port 69*b* and the manual insertion tray 70*b*, which are used when the user manually inserts print papers into the printer.

The upper case 63*b* is provided with the ink tank insertion cover 71*b*. The ink tank insertion cover 71*b* is opened for attaching and detaching to and from the printer. The ink tank 72*b* may be any of the ink tanks of the above-mentioned embodiments. In this instance, an ink tank 72*b* consists of two types of ink tanks; a monocolor ink tank which is any of the ink tanks of the first to third embodiments, and the other is a unit type ink tank of three colors of the fourth embodiment. The ink tank 72*b* is attached to a print head, not shown. The print head is mounted on a carriage, not shown. When the ink tank 72*b* is attached to the printer, the jointing-portion capillary member of the ink tank 72*b* is brought into contact with the filter of the ink introducing means of the print head, to thereby form an ink passage. Air staying in the jointing means and the ink introducing means is excluded by the jointing-portion capillary member, whereby print defects caused by air bubbles is eliminated. When the ink tank 72*b* is detached from the printer, the jointing-portion capillary member holds ink in the jointing portion and its near portion. Therefore, no ink oozes or drips. Accordingly, the printer is soiled with the ink oozed or dripped. It does not take place that ink that falls in drops and mixes with another color ink.

Print papers contained in the paper tray 74*b* are taken out sheet by sheet and transported by a paper transporting system, not shown, contained in the printer case. Alternatively, print papers are inserted sheet by sheet by a user through the manual insertion port 69*b* into the printer, and transported along the circumference of the paper feeding roller 73*b*. In operation, the ink tank 72*b* is attached to the printer, and the print head, not shown, is moved in the direction orthogonal to the paper transporting direction, whereby characters, for example, are printed every zonal area. And the paper is moved in the lengthwise direction of the paper up to the next printing position of the zonal area, by the paper feeding roller 73*b*. Repeating the operation, characters are printed on the print paper. Then, the printed paper is discharged into the paper receptacle 67*b* of the upper case 63*b*.

In the above-mentioned embodiments, the ink tank 1*b* is attached to the print head 3*b*. Such a construction that the print head 3*b* is detachably attached to the carriage may also be used. In those embodiments, the ink passage is formed by only the coupling of the ink tank 1*b* with the print head 3*b*. Also in a case where two jointing portions are used, for example, a member of the ink passage is additionally provided between the ink tank and the print head, the jointing structure of the invention is applicable to those two jointing portions.

As seen from the foregoing description, the capillary member is provided in the jointing portion of the ink tank to the print head. An amount of air staying in the jointing portion when the ink tank is attached to the printer is reduced. Therefore, a chance of forming the print defects by the air staying in the jointing portion is lessened. In other words, the print quality is improved.

As described, when the ink tank is attached to the printer, the filter of the ink introducing means of the print head is brought into contact with the capillary member. Therefore, there is eliminated the air suction taking place when the extended pipe is made to press contact with the capillary member and the latter is elastically deformed. Accordingly, when the ink tank is attached again to the printer, the amount of air bubbles that will enter the ink passage is reduced. As described in, the filter may be constructed with a metal mesh.

As described, a capillary force of the capillary member provided in the jointing portion of the ink tank to the print head is weaker than that of the ink-chamber capillary member. With this unique feature, the ink left in the jointing portion is satisfactorily held, so that when the ink tank is detached, no ink leaks and drips from the jointing portion. Particularly when the invention is applied to the color printer, the problem of the ink color mixing caused by the dripping, leakage and flowing out of color inks does not arise.

As described, the capillary means located in the jointing portion may include a second meniscus forming member, and a jointing-portion capillary member. Particularly when the jointing-portion capillary member is provided in the print head, the second meniscus forming member is essential. When the ink tank is detached from the printer, the second meniscus forming member holds the ink within the ink tank to prevent ink from leaking therefrom.

What is claimed is:

1. A recording apparatus comprising:

a print head for printing characters on a printing medium by ejecting ink droplets thereto, and an ink tank for holding ink therein to be supplied to said print head, wherein said ink tank includes:

an ink chamber having an air through-hole and an ink supplying port, said ink chamber being communicatively connected to outside air through said air through-hole and supplying ink to said print head through said ink supplying port;

an ink holding member contained in said ink chamber; and a first meniscus forming member with minute perforations formed therein, located within said ink supplying port so as to communicate with said ink holding member;

said print head includes:

an ink introducing port for introducing ink from said ink tank into said print head; and a second meniscus forming member located in said ink introducing port;

and wherein when said ink tank is attached to said print head, said ink introducing port is coupled with said ink supplying port, and an ink passing member that contacts said second meniscus forming member is provided in a portion where said ink introducing port is coupled with said ink supplying port such that the first meniscus forming member is spaced from the second meniscus forming member, the ink passing member being subject to only minor changes in volume upon contact with ink;

wherein the ink passing member has first and second ends, said first end being in contact with said first meniscus forming member and said second end being in contact with said second meniscus forming member.

2. The recording apparatus of claim 1, wherein an ink holding force of said ink passing member is equal to or larger than an ink holding force of said ink holding member.

3. The recording apparatus of claim 1, wherein minute perforations of said second meniscus forming member are comparable with or more minute than minute perforations of said first meniscus forming member.

4. The recording apparatus of claim 1, wherein said second meniscus forming member is placed on an upper surface of said ink introducing port and sealed with an elastic member.

5. The recording apparatus of claim 1, wherein the ink passing member is located in said ink introducing port.

6. A recording apparatus according to claim 1, wherein said ink passing member is deformed from 0 to 0.2 millimeters.

7. A recording apparatus according to claim 1, wherein the density of said ink passing member is approximately twice the density of the ink holding member.

8. An ink tank detachably attached to ink introducing port of a print head for printing characters on a printing medium by ejecting ink thereto, the print head including a second meniscus forming member located in the ink introducing port, the ink tank comprising:

an ink chamber having an air through-hole and an ink supplying port, said ink chamber being communicatively connected to outside air through said air through-hole and supplying ink to said print head through said ink supplying port;

an ink holding member contained in said ink chamber;

a first meniscus forming member with minute perforations formed therein, located within said ink supplying port in contact with said ink holding member; and an ink passing member located in said ink supplying port, wherein said ink tank is attached to said print head, said ink passing member being brought into contact with the ink introducing port of said recording apparatus such that the first meniscus forming member is spaced from die second meniscus forming member, the ink passing member being subject to only minor changes in volume upon contact with ink;

wherein said ink passing member includes first and second ends, said first end being in contact with said first meniscus forming member and said second end being in contact with said second meniscus forming member when the ink tank is attached to the print head.

9. The ink tank of claim 8, wherein an ink holding force of said ink passing member is equal to or larger than an ink holding force of said ink holding member.

10. An ink tank according to claim 8, wherein said ink passing member is deformed from 0 to 0.2 millimeters.

11. An ink tank according to claim 8, wherein the density of said ink passing member is approximately twice the density of the ink holding member.

12. A printer comprising a print head for printing characters on a printing medium by ejecting ink droplets to said printing medium, the print head including an ink introducing port for introducing ink to the print head, the print head also including a second meniscus forming member located in the ink introducing port, the printer also comprising an ink tank for holding ink therein to be supplied to said print head, wherein said ink tank includes:

a main ink chamber having an air through-hole and an ink through-hole, said main ink chamber being communicatively connected to outside air through said air through-hole and supplying ink to said print head through said ink through-hole;

an ink chamber capillary member contained in said main ink chamber;

a first meniscus forming member with minute perforations formed therein, located within said ink through-hole while being in contact with said ink-chamber capillary member;

an intermediate chamber having a jointing means provided in a bottom portion thereof, and communicating with said main ink chamber through said ink through-hole and said first meniscus forming member, said intermediate chamber being jointed to said print head by said jointing means; and a jointing-portion capillary means being placed in said jointing means such that the first meniscus forming member is spaced from the second meniscus member, the jointing-portion capillary means being subject to only minor changes in volume upon contact with ink;

wherein said jointing-portion capillary means has first and second ends, said first end being in contact with said first meniscus member and said second end being in contact with said second meniscus forming member.

13. The printer of claim 10, wherein said print head includes an ink introducing means to be coupled with said jointing means of said ink tank, a filter is formed on a face of said ink introducing means which is confronted with said jointing means of said ink tank, and when said ink tank is attached to said print head, said filter of said ink introducing means is brought into contact with said jointing-portion capillary means of said jointing means.

14. The printer of claim 11, wherein said filter is formed with a metal mesh.

15. The printer of claim 10, wherein a capillary force of said jointing-portion capillary means is weaker than that of said ink-chamber capillary member.

16. A printer according to claim 12, wherein said jointing-portion capillary means is deformed from 0 to 0.2 millimeters.

17. A printer according to claim 12, wherein the density of the jointing portion capillary means is approximately twice the density of said ink chamber capillary member.

18. An ink tank detachably connectable to a print bead of a printer for printing characters on a printing medium by ejecting ink to said printing medium, the print head including an ink introducing port for introducing ink to the print head, the print head also including a second meniscus forming member located in the ink introducing port, said ink tank comprising:

a main ink chamber having an air through-hole and an ink through-hole, said main ink chamber being communicatively connected to outside air through said air through-hole and supplying ink to said print head through said ink through-hole;

an ink-chamber capillary member contained in said main ink chamber;

a first meniscus forming member with minute perforations formed therein, located within said ink through-hole while being in contact with said ink-chamber capillary member;

an intermediate chamber having a jointing means provided in a bottom thereof, and communicating with said main ink chamber through said ink through-hole and said first meniscus forming member, said intermediate chamber being jointed to said print head by said jointing means; and a jointing-portion capillary means being placed in said jointing means such that the first meniscus forming member is spaced from the second meniscus forming member, the jointing-portion capillary means being subject to only minor changes in volume upon contact with ink;

wherein said jointing-portion capillary means has first and second ends, said first end being in contact with said first meniscus member and said second end being in contact with said second meniscus forming member when said ink tank is attached to said print head.

19. An ink tank according to claim 18 wherein said jointing-portion capillary means is deformed from 0 to 0.2 millimeters.

20. An ink tank according to claim 18, wherein the density of said jointing-portion capillary means is approximately twice the density of the ink-chamber capillary member.

21. A recording apparatus comprising:

a print head for printing characters on a printing medium by ejecting ink droplets thereto, and an ink tank for holding ink therein to be supplied to said print head, wherein said ink tank includes:

an ink chamber having an air through-hole and an ink supplying port, said ink chamber being communicatively connected to outside air through said air through-hole and supplying ink to said print head through said ink supplying port;

an ink holding member contained in said ink chamber; and a first meniscus forming member with minute perforations formed therein, located within said ink supplying port so as to communicate with said ink holding member;

said print head includes:

an ink introducing port for introducing ink from said ink tank into said print head; and a second meniscus forming member located in said ink introducing port;

and wherein when said ink tank is attached to said print head, said ink introducing port is coupled with said ink supplying port, and an ink passing member that contacts said second meniscus forming member is provided in a portion where said ink introducing port is coupled with said ink supplying port such that the first meniscus forming member is spaced from the second meniscus forming member the ink passing member being subject to only minor changes in volume upon contact with ink;

wherein the density of said ink passing member is approximately twice the density of the ink holding member.

22. An ink tank detachably attached to an ink introducing port of a print head for printing characters on a printing medium by ejecting ink thereto, the print head including a second meniscus forming member located in the ink introducing port, the ink tank comprising:

an ink chamber having an air through-hole and an ink supplying port, said ink chamber being communicatively connected to outside air through said air through-hole and supplying ink to said print head through said ink supplying port;

an ink holding member contained in said ink chamber;

a first meniscus forming member with minute perforations formed therein, located within said ink supplying port in contact with said ink holding member; and an ink passing member located in said ink supplying port, when said ink tank is attached to said print head, said ink passing member being brought into contact with the ink introducing port of said recording apparatus such that the first meniscus forming member is spaced from the second, meniscus forming member, the ink passing member being subject to only minor changes in volume upon contact with ink;

wherein the density of said ink passing member is approximately twice the density of the ink holding member.

23. A printer comprising a print head for printing characters on a printing medium by ejecting ink droplets to said printing medium, the print head including an ink introducing port for introducing ink to the print head, the print head also including a second meniscus forming member located in the ink introducing port, the printer also comprising an ink tank for holding ink therein to be supplied to said print head, wherein said ink tank includes:

a main ink chamber having an air through-hole and an ink through-hole, said main ink chamber being communicatively connected to outside air through said air through-hole and supplying ink to said print head through said ink through-hole;

an ink chamber capillary member contained in said main ink chamber;

a first meniscus forming member with minute perforations formed therein, located within said ink through-hole while being in contact with said ink-chamber capillary member;

an intermediate chamber having a jointing means provided in a bottom portion thereof, and communicating with said main ink chamber through said ink through-hole and said first meniscus forming member, said intermediate chamber being jointed to said print head by said jointing means; and a jointing-portion capillary means being placed in said jointing means such that the first meniscus forming member is spaced from the second meniscus member, the jointing-portion capillary means being subject to only minor changes in volume upon contact with ink;

wherein the density of the jointing portion capillary means is approximately twice the density of said ink chamber capillary member.

24. An ink tank detachably connectable to a print head of a printer for printing characters on a printing medium by ejecting ink to said printing medium, the print head including an ink introducing port for introducing ink to the print head, the print head also including a second meniscus forming member located in the ink introducing port, said ink tank comprising:

a main ink chamber having an air through-hole and an ink through-hole, said main ink chamber being communicatively connected to outside air through said air through-hole and supplying ink to said print head through said ink through-hole;

an ink-chamber capillary member contained in said main ink chamber;

a first meniscus forming member with minute perforations formed therein, located within said ink through-hole while being in contact with said ink-chamber capillary member;

an intermediate chamber having a jointing means provided in a bottom thereof, and communicating with said main ink chamber through said ink through-hole and said first meniscus forming member, said intermediate chamber being jointed to said print head by said jointing means; and a jointing-portion capillary means being placed in said jointing means such that the first meniscus forming member is spaced from the second meniscus forming member, the jointing-portion capillary means being subject to only minor changes in volume upon contact with ink;

wherein the density of said joint-portion capillary means is approximately twice the density of the ink-chamber capillary member.

* * * * *